US011110506B2

(12) United States Patent
McLaughlin et al.

(10) Patent No.: US 11,110,506 B2
(45) Date of Patent: Sep. 7, 2021

(54) VARIABLE PULSATING, GAP CONTROL, AUTO-LEARNING PRESS CUSHION DEVICE

(71) Applicant: Barnes Group Inc., Bristol, CT (US)

(72) Inventors: Ethan McLaughlin, Bristol, CT (US); Richard Miller, Akron, OH (US); Steven Reilly, Westlake, OH (US); Michael Culbertson, Cuyahoga Falls, OH (US); Russ Sasak, Bristol, CT (US)

(73) Assignee: Barnes Group Inc., Bristol, CT (US)

( * ) Notice: Subject to any disclaimer, the term of this patent is extended or adjusted under 35 U.S.C. 154(b) by 183 days.

(21) Appl. No.: 15/783,078

(22) Filed: Oct. 13, 2017

(65) Prior Publication Data

US 2018/0104736 A1 Apr. 19, 2018

Related U.S. Application Data

(60) Provisional application No. 62/409,639, filed on Oct. 18, 2016.

(51) Int. Cl.
*B21D 24/14* (2006.01)
*B21D 24/02* (2006.01)

(52) U.S. Cl.
CPC ..... *B21D 24/14* (2013.01); *B21D 24/02* (2013.01)

(58) Field of Classification Search
CPC .... B21D 24/14; B21D 24/02; B30B 15/0094; B30B 15/28; B30B 15/165; B30B 15/26; G05B 19/4063; G05B 2219/50197
USPC ..... 72/453.13, 19.9
See application file for complete search history.

(56) References Cited

U.S. PATENT DOCUMENTS 4,548,066 A * 10/1985 Martinez ..... G01B 7/10 324/229
4,750,131 A * 6/1988 Martinez ..... B30B 15/0094 700/206
5,042,362 A * 8/1991 Schulze ..... B21D 28/002 91/29
5,457,980 A 10/1995 Kirii et al.
8,127,590 B2 3/2012 Kohno et al.
(Continued)

OTHER PUBLICATIONS

U.S. Search Authority, International Search Report and Written Opinion for corresponding application No. PCT/US2017/056488 (dated Jan. 12, 2018).

*Primary Examiner* — Adam J Eiseman
*Assistant Examiner* — Mohammed S. Alawadi
(74) *Attorney, Agent, or Firm* — Ulmer & Berne LLP; Brian E. Turung

(57) ABSTRACT

A controllable force cushion device that can be programmed to provide a variable and/or pulsating force that can be used in any application where force control is desirable. The frequency of the pulsation can be adjusted to suit different applications and/or circumstances (e.g., forming of sheet metals in die applications, etc.). The cushion can comprise one or more manifolds containing hydraulic cylinders that can be compressed during operation pushing fluid through a proportional relief valve that can be controlled by a motion control device, thereby creating a desired force. Material (e.g., sheet metal, etc.) flow can be controlled by using a gap control method. In use, the variable pulsating, gap control, auto-learning press cushion device of the present invention can optionally be mounted to the underside of a press bolster and can be used in conjunction with a stamping press.

20 Claims, 15 Drawing Sheets

(56) References Cited

U.S. PATENT DOCUMENTS

| | | | | |
|---|---|---|---|---|
| 8,757,056 | B2 * | 6/2014 | Kohno | B21D 24/14 100/269.01 |
| 2003/0116037 | A1 * | 6/2003 | Tanaka | B30B 15/26 100/282 |
| 2011/0045113 | A1 * | 2/2011 | Miyasaka | B21D 24/02 425/145 |
| 2011/0226141 | A1 * | 9/2011 | Kohno | B21D 24/14 100/269.01 |
| 2014/0366606 | A1 | 12/2014 | Kohno et al. | |
| 2015/0185726 | A1 | 7/2015 | Kohno | |
| 2017/0182539 | A1 * | 6/2017 | Makabe | B21D 24/02 |

* cited by examiner

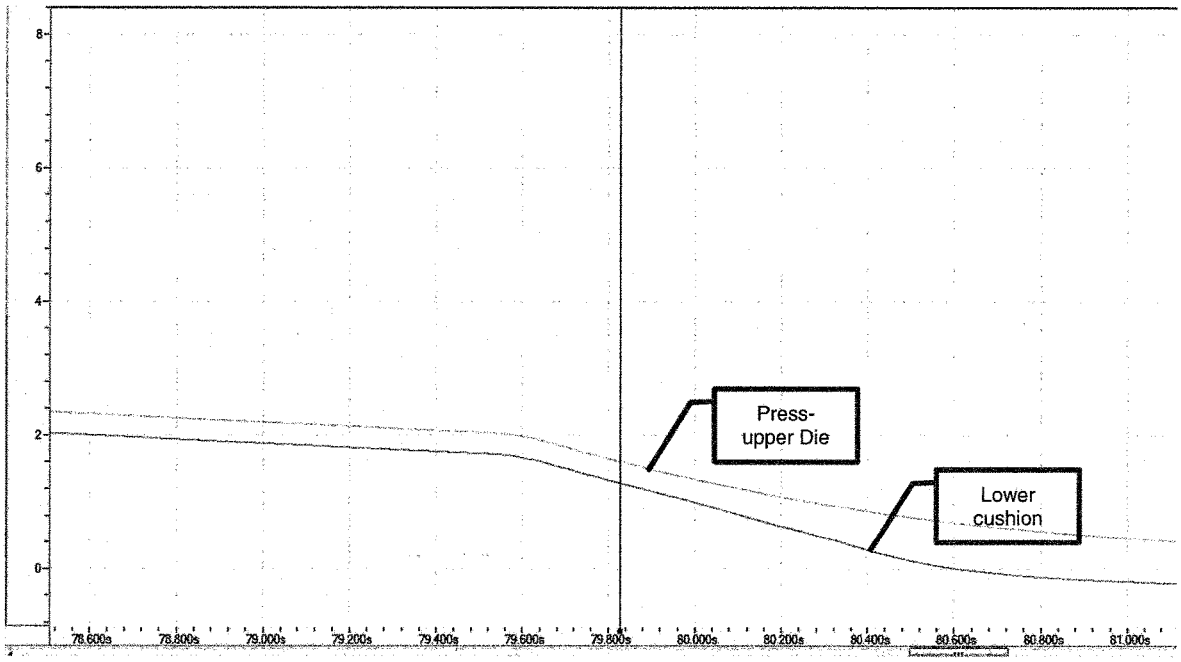
FIG. 11 - Wrinkle
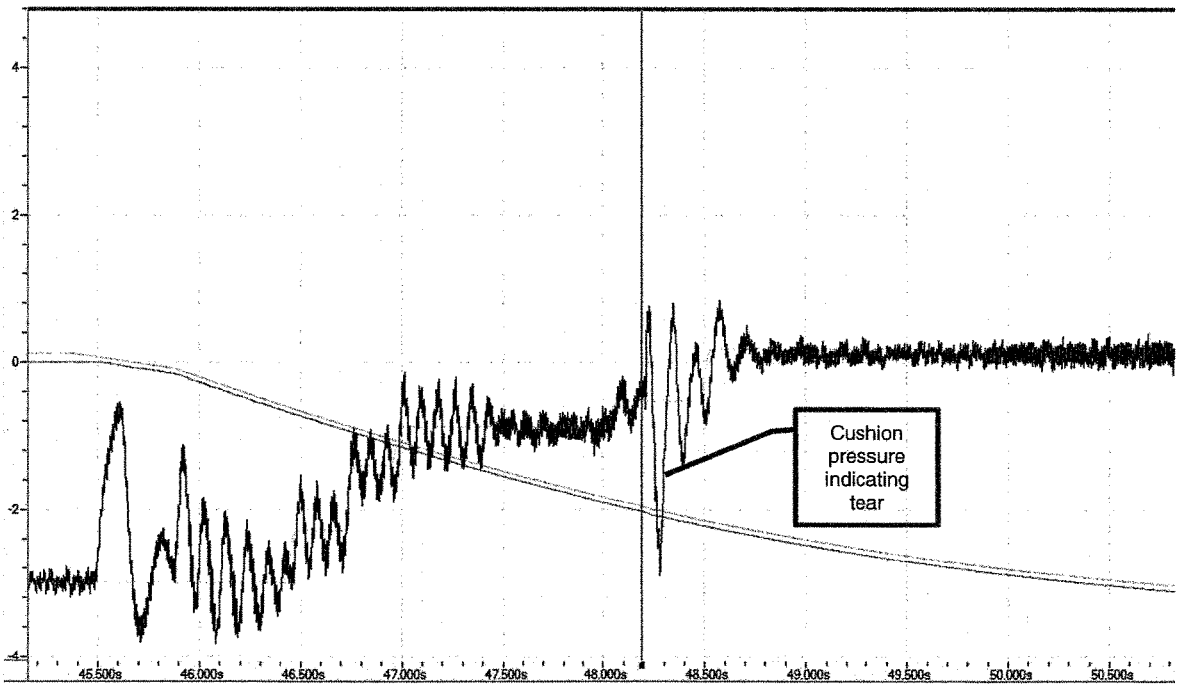
FIG. 12 - Tear

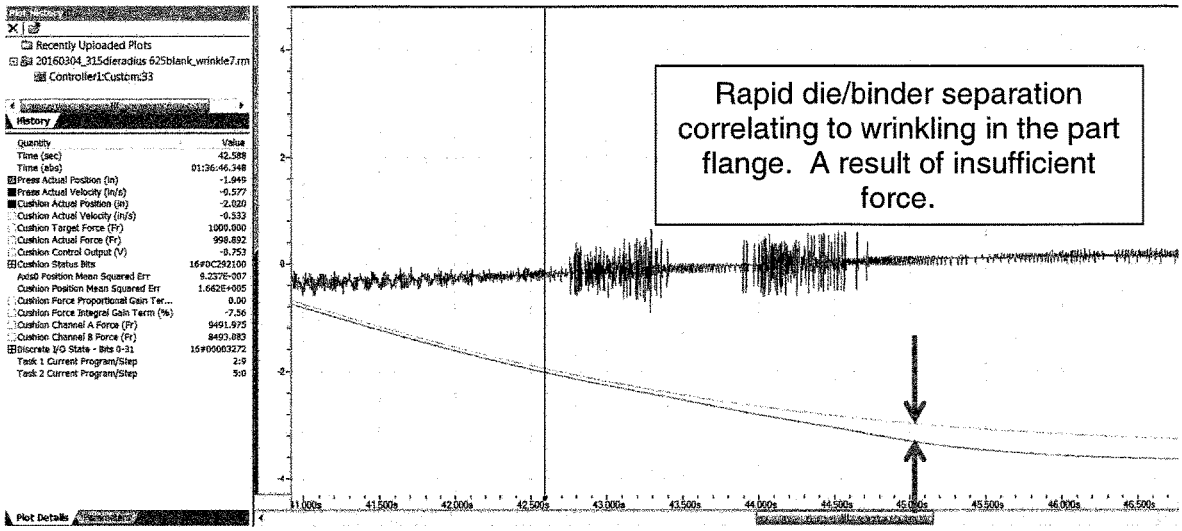
FIG. 13 - Wrinkle
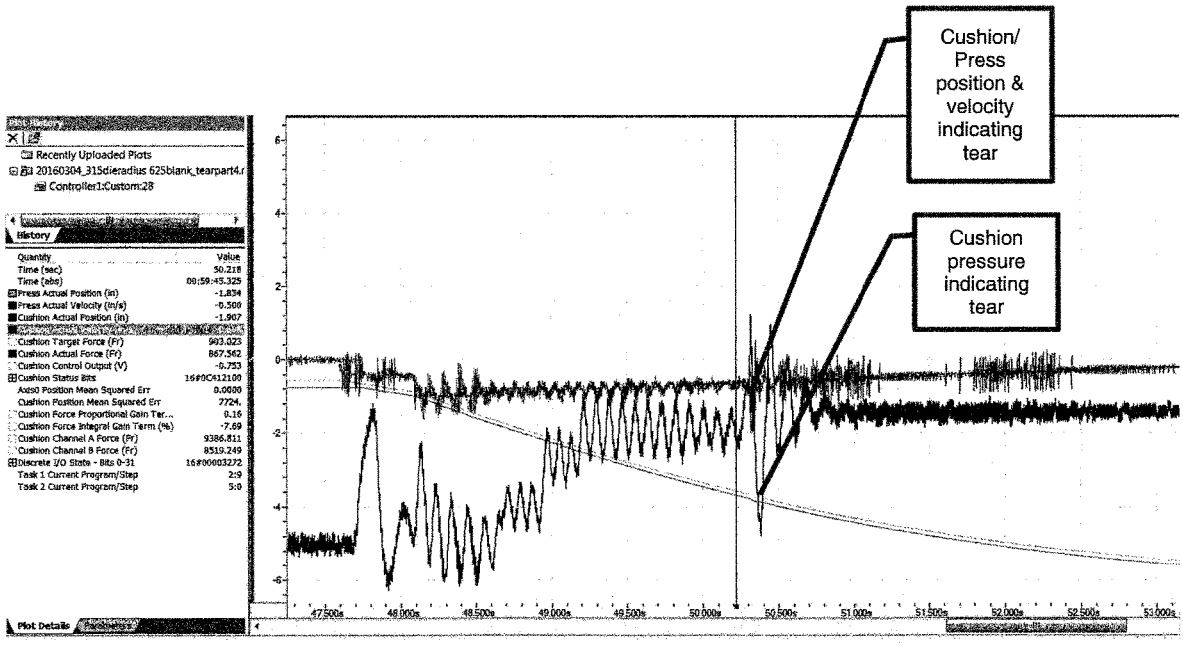
FIG. 14 - Tear

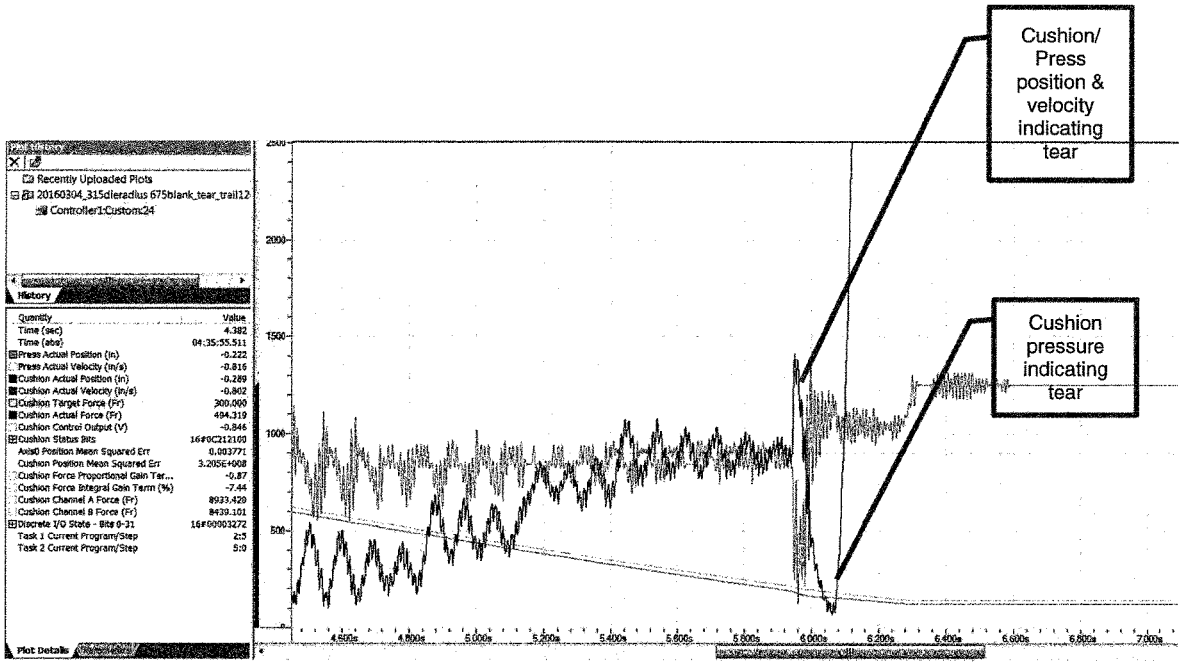
FIG. 15 Tear

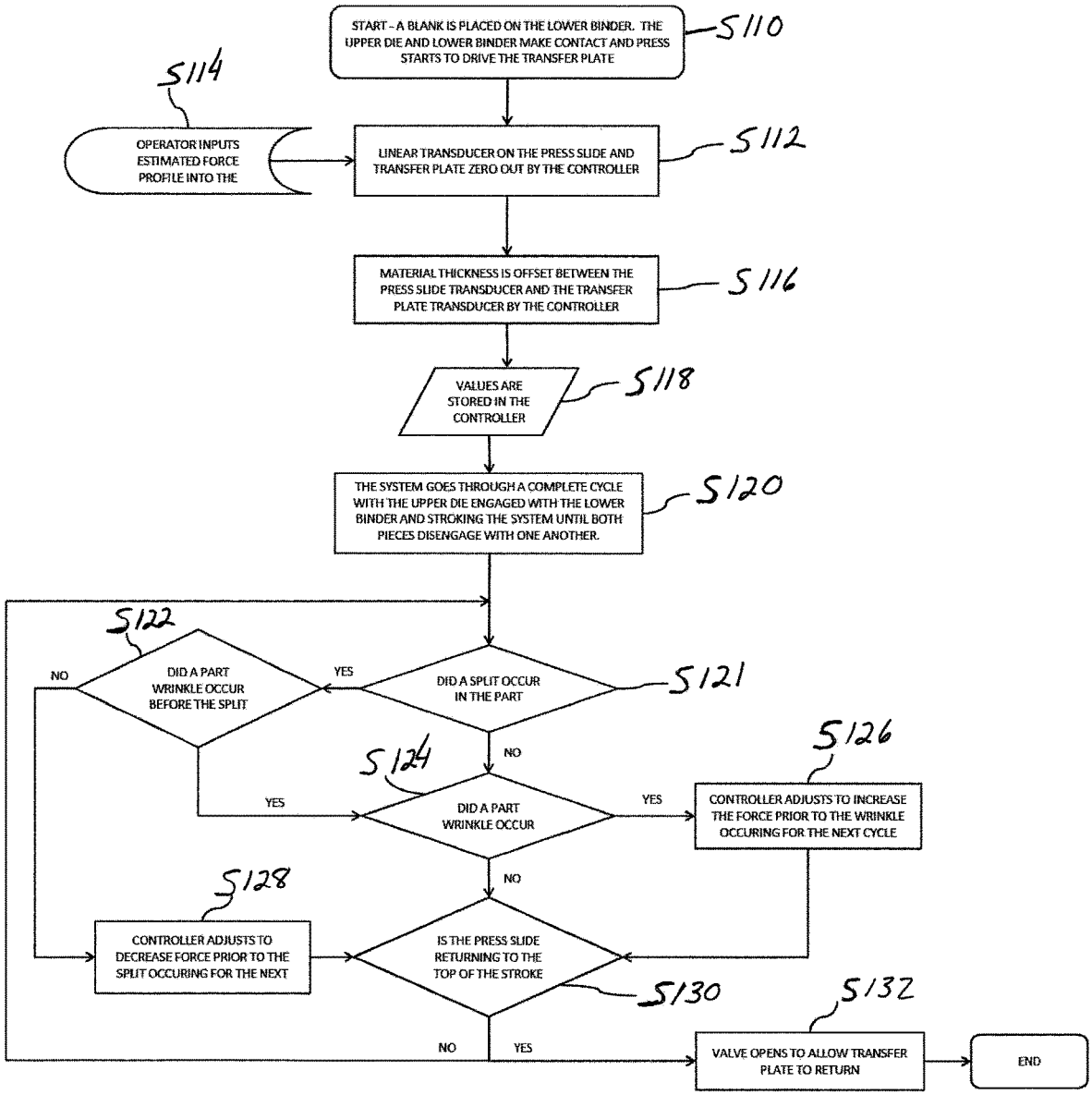
FIG. 16 – Auto Learning Control Sequence

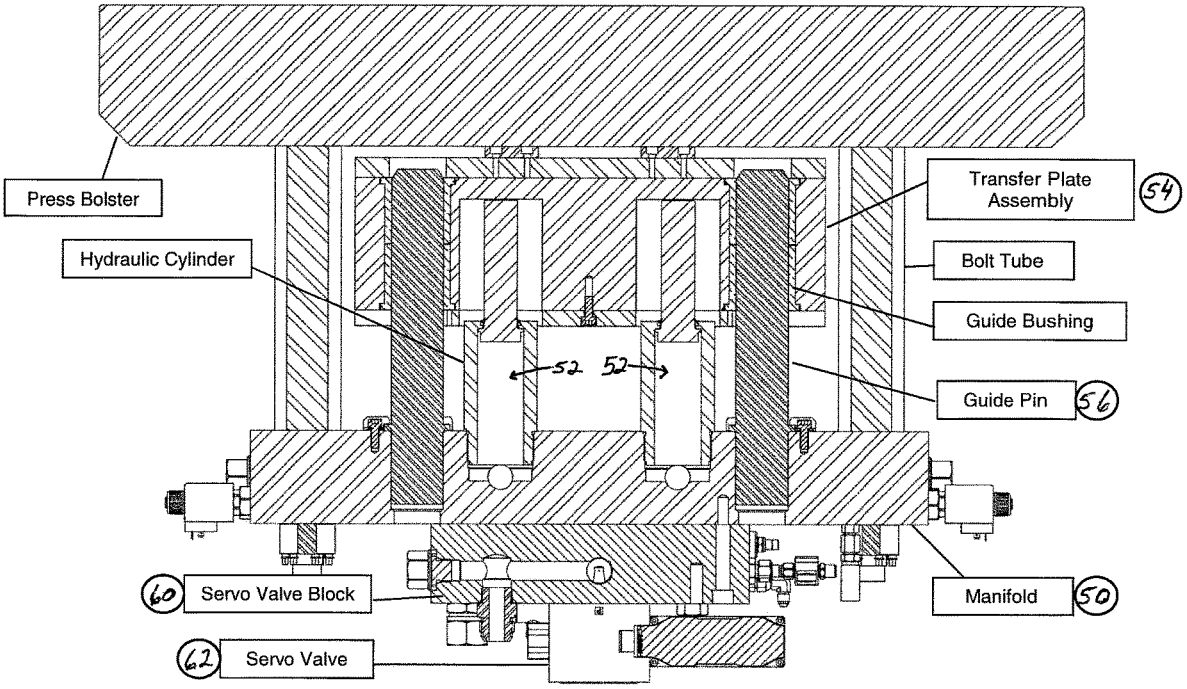
FIG. 17 – Cross Section of Cushion Attached to Press Bolster

VARIABLE PULSATING, GAP CONTROL, AUTO-LEARNING PRESS CUSHION DEVICE

The present invention claims priority on U.S. Provisional Application No. 62/409,639 filed Oct. 18, 2016, which is incorporated herein by reference.

The present invention is directed to metal forming devices. The invention finds particular attention to sheet metal stamping for automotive, commercial, and residential applications, and is described with particular reference thereto. However, it is to be appreciated that the present exemplary embodiment is also amenable to other like applications.

BACKGROUND ON THE INVENTION

With new technology, increased industry regulation standards, and higher consumer demand, steel manufacturers are faced with the task of making stronger yet lighter stamped steel components. Conventional stamping techniques require a series of processes to manufacture these complex, high-strength parts. It would be desirable to incorporate a device into traditional steel stamping devices such that parts can be manufactured without the additional processing steps required by conventional techniques and methods while still maintaining a high level of repeatability.

Current hydraulic die cushions can be made capable of varying force through the stroke of the press. Optionally, the press can be used as the driver of the cushion and a proportional relief valve can be used to build pressure in the cushion. A pressure sensor can be located in the cushion that optionally senses pressure throughout the stroke of the cushion that optionally sends feedback to a controller for the purpose of adjusting the valve position according to a pre-set, desired force setting.

Press cushions (e.g., servo press cushions, etc.) that can vary force are useful in sheet metal applications (e.g., forming and drawing sheet metal, etc.). By only varying the force of the stroke used to draw parts, certain part geometries and materials can still require additional processing to be completed. As such, current cushion designs have limitations and improvements are needed.

Kohno (U.S. Pat. No. 8,757,056), Kohno et al. (U.S. Pat. No. 8,127,590) and Kirii et al. (U.S. Pat. No. 5,457,980) each teach a press device that is force controlled. However, these references fail to teach a device wherein the force is controlled and also pulsating simultaneously.

Kohno teaches a die cushion device for a press machine comprising a hydraulic power unit (HPU). Hydraulic power units pose several disadvantages. One such disadvantage is that electricity is required in order to run the motor which powers the hydraulic pump which then feeds oil to the device. As such, heat generation is greater because all the force that is being generated is being transferred to heat and is therefore not regenerative.

One limiting factor of current press cushion devices is the maximum force needed in different stages of the stroke in order to draw a part without yielding the material to a point where splits or wrinkles occur. By varying only the force, certain part geometries and materials can still require additional processing to be completed.

In view of the prior art, there remains a need for a pulsating frequency, variable force press cushion device that can be easily and conveniently incorporated into an existing press cushion device for the purpose of improving formation and drawing of sheet metals and other like applications.

SUMMARY OF THE INVENTION

The present invention is directed to a sheet metal stamping system that incorporates the use of a pulsating frequency, variable force press cushion device to improve the formation and drawing of sheet metals.

Disclosed in various non-limiting embodiments of the present invention are novel press cushion devices that are useful in a wide range of applications and can be adaptable to various pre-existing and future press makes and models.

Generally, five factors are responsible for controlling metal flow in die applications: geometry of the blank, draw beads, lubrication and friction, blank holder and punch velocities, and blank holder surface pressure. According to one non-limiting aspect of the present invention, the variable pulsation, gap control, auto-learning press cushion device of the present invention provides optional control of one or more of the following variables: the blank holder velocity (via the driving motion of the press); and control of the blank holder pressure, which can be varied by pulsing throughout the stroke of the press, gap control (for blank thickness) between the upper die (ram) and the lower die binder in which the press cushion device of the present invention The prior art has demonstrated the idea of variable force control and force pulsation separately. However, the prior art fails to teach these two concepts together and provides no evidence showing that it would be desirable to do so. The novel variable pulsating, gap control, auto-learning press cushion device of the present invention provides a combination of these two components into one system; and wherein the system of the present invention is capable of controlling both of these components simultaneously. The advantages of each component separately can thus be combined into one system which magnifies the effectiveness of the system in accordance with the present invention.

According to one non-limiting aspect of the present invention, the variable pulsating, gap control, auto-learning press cushion device can be configured to operate both with and/or without a hydraulic power unit.

According to another or alternative non-limiting aspect of the present invention, the novel variable pulsating, gap control, auto-learning press cushion device can optionally comprise a basic manifold including one or more hydraulic cylinders driven by a press slide via transfer pins contacting a transfer plate or cylinder pistons and a binder in the die driven by said press slide. In one non-limiting aspect of the invention, the variable pulsating, gap control, auto-learning press cushion device includes multiple small cylinders instead of fewer large cylinders. The use of smaller cylinders, which can be defined as cylinder bore diameters ranging from 1.125" to 3.00", allow the system to have less compressibility in the hydraulic oil and components. The compact design of multiple cylinders allows the system to be controlled with a higher degree of force accuracy.

According to another or alternative non-limiting aspect of the present invention, the pressure/force can optionally be controlled by an electro-proportional valve which adjusts based on information received from an optional motion controller. The proportional valve can be mounted in close proximity to the cylinders to limit the effects of the compressibility of the oil; however, this is not required.

According to another or alternative non-limiting aspect of the present invention, the force can be both variable and pulsing.

According to another or alternative non-limiting aspect of the present invention, an operator can enter the pulse width frequency through the use of a human machine interface (HMI); however, this is not required.

According to another or alternative non-limiting aspect of the present invention, the frequency can be communicated to a controller in which force can remain as programmed, yet the frequency can be changed based on any value entered in the HMI; however, this is not required.

According to another or alternative non-limiting aspect of the present invention, an operator can enter the pulse width amplitude through the use of a HMI; however, this is not required.

According to another or alternative non-limiting aspect of the present invention, the amplitude can be communicated to the controller in which force remains variable or constant, yet the amplitude can be changed based on any value entered in the HMI; however, this is not required.

According to another or alternative non-limiting aspect of the present invention, gap control can optionally be used as an effective method in forming/drawing material wherein a controller can automatically adjust force based on gap differences between the press slide and the transfer plate; however, this is not required. For gap control operation, the system control variable becomes the gap between the height position of the upper die components (ram, upper die, etc.) and the height position of the lower die components (binder ring, lower die, cushion, transfer plate, etc.). For gap control operation, the cushion forces are assumed to be sufficiently high enough to maintain the required gap and overcome forces from the material being formed. For gap control operation, the cushion forces are also assumed to be at a minimal amount to maintain the required gap, thus reducing friction which allows the material to flow at an optimal rate. During forming of the metal component, gap control can be used to effect the amount of compression from the binder to the blank material. If the gap is too large, the blank will wrinkle. If the gap is too small, the part will tear. The gap control can be programmed by the user; however, this is not required. The user can enter the height and the gap distance; however, this is not required. For most materials, the gap distance will increase as the blank material is drawn into the die.

According to another or alternative non-limiting aspect of the present invention, the value of said gap can optionally be programmed to automatically adjust throughout the stroke of the press. The draw height and gap distance can be obtained from FEA (Finite Element Analysis) software, other types of software, or by other means and directly linked to the cushion control; however, this is not required.

According to another or alternative non-limiting aspect of the present invention, auto-learning (tuning) of die tryout or continuous monitoring of the part because of blank material property variations can be achieved in accordance with the present invention.

During the auto-learning operation for a specific draw process, the cushion control system can be configured to monitor the position of the upper die components and the lower die components, and compare the difference between the two to calculate the resultant gap; however, this is not required.

The cushion controller can calculate the slope of the position curve for both the upper and lower die components, and the system can be configured to compare the slopes of the two components for congruence. Slope matching can optionally be used to compare within a known amount (e.g., defined by the user, defined by some means) as a process variable. When the slope of the two curves differs beyond the amount defined as the process variable, an alert can be identified as a learning point that the existing process is outside of the desired operation. The process can then be adjusted based on the learned points.

For operation of force controlled systems, gap measurement and comparison of the slope of the die components during forming can optionally be used to define an operational force profile that makes a successful part based on auto-learned points. During forming, if the slopes differ beyond the prescribed process variable, this will be recognized as a learning point, and the cushion force can be varied (lesser or greater) to prevent the variable from falling out of range and thereby result in a successful forming operation. Learning points can optionally be recorded in an iterative process to define a force curve throughout the forming operation that results in a successfully formed part.

For gap control operation, learning points can be used to make adjustments to the prescribed forming gap, based on real world effects; however, this is not required.

The cushion program can optionally be used to calculate the slope of the gap (gap distance vs. time). Upper ram (upper die) along with the lower die cushion height can optionally be used calculate the optimal force needed draw a part.

The gap profile for a part can be used to program the gap control on future parts; however, this is not required. Gap or force control can optionally be used depending on requirements of the material and part.

Draw simulation (as defined by the process simulation) can optionally be directly linked to the cushion, allowing close force approximation required for the first tryout.

The control system of the cushion can optionally monitor the ram position and velocity to scan for small spike created by the part tearing during the draw process. The control system can optionally be configured to also measure the velocity change of the cushion which will show the material has torn. Cushion pressure change can be optionally monitored and can optionally be used to show the material change performance.

Information to assist with quality control during drawing process can optionally be communicated out for evaluation by the operator, production and/or quality department.

One non-limiting example of auto-learning in accordance with the present invention is as follows: A new die is provided. The new die tryout can be a time and material consuming process. The operator selects auto-learning on the HMI panel. The HMI will allow the preliminary force values and heights to be entered, if the user has this data. The data can optionally be downloaded from outside the FEA program (as defined by the process simulation) through the internet. If preliminary data is not available from FEA and approximate forces are not available, the auto-learning of the cushion can be used to draw multiple blanks to approximate the force required. Once the approximate force is recorded along the draw depth, the variable pulsating, gap control, auto-learning press cushion device will control the forming process by stamping multiple blanks. Each time a new blank is drawn, the control system of the cushion will analyze every 0.001" (or some other value [0.0001-1 inch and all values and ranges therebetween]) of the ram (upper die) and lower cushion travel to determine when the binder gap is growing too quickly due to wrinkling in the material or too slowly which indicates tearing in the part. The data will be recorded to find the desired force and height location to give the highest quality part. By controlling the force, the control system allows for size and material variance of the blank without causing the part to be out of tolerance and scrapped. Once the die tryout has been complete or the force for the drawn part has been determined, the system will can draw the part using gap control and/or force control. Variable pulsating can optionally be used on either gap control or force control. Gap control can optionally use a higher frequency and smaller amplitude depending on the gap tolerance.

According to another or alternative non-limiting aspect of the present invention, cylinder or transfer plate position can optionally be calculated from pressure rise in an accumulator wherein a controller can convert the pressure rise to volume of oil to linear position of the cylinder; however, this is not required.

According to another or alternative non-limiting aspect of the present invention, cylinder or transfer plate position can optionally be calculated from a flow rate sensor in a manifold wherein the flow rate can be converted to a linear velocity which can then be translated from a rate to a physical position; however, this is not required.

According to another or alternative non-limiting aspect of the present invention, the press cushion device can optionally be configured to use a hydraulic power unit which optionally comprises a pump and motor for the purpose of moving fluid through the system.

According to another or alternative non-limiting aspect of the present invention, the press cushion device in accordance with the present invention can optionally be configured to be regenerative and utilize a pressurized device (such as an accumulator) wherein fluid can be driven through a proportional valve to the accumulator and released back into the system to raise the cushion to the top; however, this is not required.

According to another or alternative non-limiting aspect of the present invention, the press cushion device can optionally automatically learn force profiles and optionally store them in the HMI to be recalled in the future; however, this is not required.

According to another or alternative non-limiting aspect of the present invention, the press cushion device can be capable of importing and using simulation data collected from sheet metal simulation software; however, this is not required.

According to another or alternative non-limiting aspect of the present invention, the data can optionally be transferred to a controller via a USB™ device, an HMI, wirelessly, or by some other communication means; however, this is not required.

According to another or alternative non-limiting aspect of the present invention, the data can optionally be in Excel™ column format or any format recognized by the controller such that the controller can properly interpret the data.

In summary, there is provided a die press cushion device for a press machine comprising a) at least one hydraulic cylinder supporting a cushion platform, the cushion platform configured to move in response to a force applied thereto by a slide of a press machine; b) a control valve configured to permit flow, restrict flow, or combinations thereof of hydraulic fluid from a chamber of the at least one hydraulic cylinder; and c) a controller configured to selectively open, close, or combinations thereof said control valve to maintain a minimum pressure in said chamber of said hydraulic cylinder to thereby control movement of said cushion platform when said slide of said press machine applies a force thereto; wherein said controller is operative to control said control valve to vary a value of said minimum pressure during a stroke of said press machine. The controller can be operative to control the control valve (e.g., proportional control valve) to pulse a pressure in the chamber of the at least one hydraulic cylinder; however, this is not required. The die press cushion device can further comprise a HMI wherein an operator can enter a pulse width frequency for the pressure of the hydraulic fluid, and the controller is operative to actuate the control valve to achieve a pulse width frequency of the hydraulic fluid; however, this is not required. The pulse width frequency can be communicated to the controller in which pressure remains as programmed yet the pulse width frequency can be changed based on any value entered in the HMI; however, this is not required. The operator can enter a pulse width amplitude through use of the HMI and the controller is operative to actuate the control valve to achieve the pulse width amplitude of the hydraulic fluid; however, this is not required. The pulse width amplitude can be communicated to the controller in which pressure remains variable and/or constant and the pulse width amplitude is changed based on any value entered in the HMI; however, this is not required. The press cushion device can further comprise a position transducer (e.g., linear position transducer, etc.) operative to provide position feedback of the cushion platform to the controller, and wherein the controller is configured to control a gap between the press slide and the cushion platform based at least in part on feedback from the position transducer by selectively opening, closing, or combinations thereof the control valve; however, this is not required. The controller can be configured to adjust the pressure of the hydraulic fluid via the control valve based at least in part on variations in the gap between the press slide and the cushion platform during a stroke of the press machine; however, this is not required. The press cushion device can further comprise an accumulator for receiving pressurized fluid from the at least one hydraulic cylinder, and wherein a position of the cushion platform can be calculated from a pressure rise in the accumulator; however, this is not required. The press cushion device can further comprise a flow rate sensor configured to sense a flow rate from the at least one hydraulic cylinder, and wherein a position of the cushion platform can be calculated using the sensed flow rate from the flow rate sensor; however, this is not required. The press cushion device can further comprise a hydraulic power unit that includes a pump and a motor for supplying pressurized fluid to the at least one hydraulic cylinder; however, this is not required. The press cushion device can further comprise an accumulator for storing pressurized fluid when the cushion pad is displaced by the press slide, and the stored pressurized fluid is available for returning the cushion pad to its beginning position or some other position; however, this is not required. The press cushion device can further comprise at least one of a pressure transducer for supplying a pressure feedback signal indicative of the lower chamber pressure to the controller and/or a position transducer (e.g., linear position transducer, etc.) is operative to provide position feedback of the cushion platform to the controller, and wherein the controller is configured to: a) monitor one or more conditions of the press cushion device during a stroke of the press machine during the forming a part using a first force profile, and wherein the one or more monitored conditions include at least one of a position of or a pressure applied by the lower chamber; b) analyzing the one or more monitored conditions to detect occurrence of a defect in the part; and, c) when a defect is detected, alter at least one parameter of said first force profile in a manner to reduce a recurrence of the detected defect; however, this is not required. The controller can be further configured to learn force profiles and then store them in a HMI and/or other storage location to be recalled in the future; however, this is not required. There is also provided a method of controlling a press cushion device of a press comprising: a) forming a first part using the press under a first force profile; b) monitoring one or more conditions of the press during the forming of the first part, and wherein the one or more monitored conditions include at least one of a position of a press slide, a position of the cushion platform and/or a pressure applied by or to the cushion platform; c) analyzing the one or more monitored conditions to detect a defect in the first part and, if a defect is detected, altering at least one parameter of the first force profile to form a second force profile, and wherein the first force profile is modified in a manner to reduce recurrence of the detected defect in said first part; and d) forming a second part using said press under the second force profile. The method can further comprise the steps of i) monitoring one or more conditions of the press during the forming of the second part, and wherein the monitored one or more conditions include at least one of a position of a press slide, a position of the cushion platform, and/or a pressure applied by and/or applied to the cushion platform, and ii) analyzing the one or more monitored conditions to detect a defect in the second part and, when a defect is detected, altering at least one parameter of the second force profile to form a third force profile, and wherein the second force profile is modified in a manner to reduce recurrence of the detected defect in the second part, and optionally also reduce the recurrence of the detected defect in the first part; however, this is not required. The step of analyzing the one or more monitored conditions can include comparing position data of the press slide to position data of the cushion platform to detect the formation of a wrinkle in the part; however, this is not required. The step of analyzing the monitored conditions can also or alternatively include detecting a pressure relief spike of one or more corresponding to a tear in the part; however, this is not required. The step of analyzing the one or more monitored conditions can also or alternatively include detecting a velocity change in the cushion platform that is indicative of a tear in the part; however, this is not required.

These and other objects, features, and advantages of the present invention will become apparent from the subsequent description taken in conjunction with the accompanying drawings.

BRIEF DESCRIPTION OF THE DRAWINGS

Referring now to the drawings wherein the showing is for the purpose of illustrating non-limiting embodiments of the invention only and not for the purpose of limiting the same:

FIG. 11 is a plot of the upper die and lower cushion positions over time indicative of wrinkle formation in an exemplary stroke of the press machine;

FIG. 12 is a plot of cushion pressure over time indicative of a tear in an exemplary stroke of the press machine;

FIG. 13 is a plot illustrating rapid die/binder separation correlating to wrinkling in the part flange during an exemplary stroke of the press machine;

FIG. 14 is a plot of cushion position/velocity and pressure over time indicative of a tear during an exemplary stroke of the press machine;

FIG. 15 is a plot of cushion position/velocity and pressure over time indicative of a tear in another exemplary stroke of the press machine;

FIG. 16 is a process flow chart illustrating an optional function of the auto-learning control in accordance with an exemplary embodiment of the present disclosure; and, FIG. 17 is a cross-section of a cushion attached to a press bolster in accordance with the present disclosure.

DETAILED DESCRIPTION OF THE INVENTION

Figure 1:
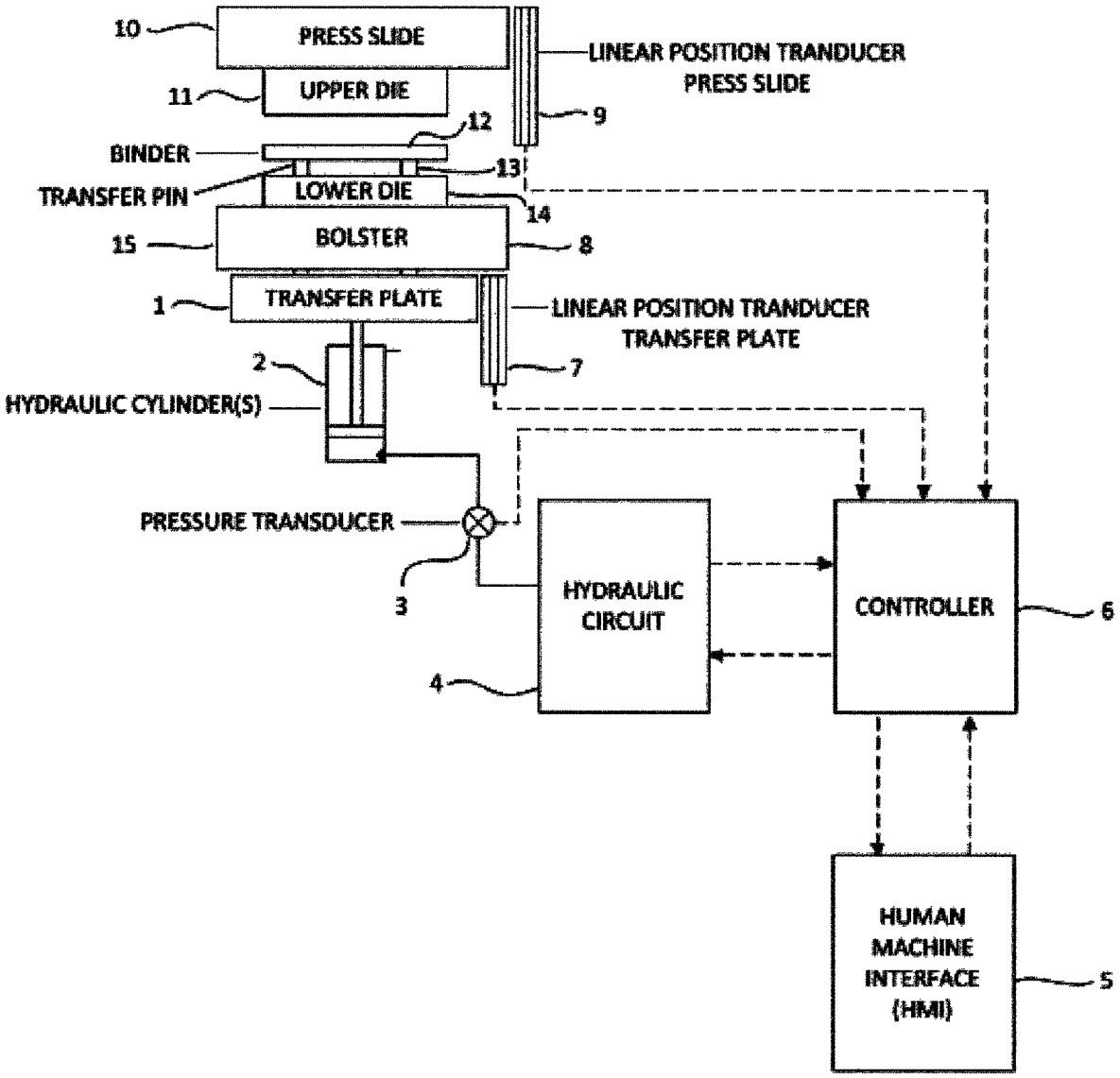
FIG. 1 is a perspective illustration of the press cushion device according to one non-limiting aspect of the present invention.

An exemplary non-limiting embodiment of the present invention includes a variable pulsating, gap control, auto-learning press cushion device suitable for use in the formation of different sheet metal components typically used in the automotive industry. Although the variable pulsating gap control, auto-learning press cushion device of the present invention described herein is illustrated in an exemplary embodiment as being associated with sheet metal and automotive applications, the variable pulsating, gap control, auto-learning press cushion device can also be used for other or alternative materials and/or other commercial and recreational applications.

The variable pulsating, gap control, auto-learning press cushion device of the present invention can be incorporated into a wide range of press makes and models and can also be adaptable to many pre-existing and future die press systems where force control is desired. Press cushions can optionally be sized according to the desired output force and stroke length and yet still fit in the press without much ancillary work involved. According to one non-limiting aspect of the present invention, the variable pulsating, gap control, auto-learning press cushion device has a modular design that can be expanded or reduced to fit in many different configurable sizes; however, this is not required.

The variable pulsating, gap control, auto-learning press cushion device of the present invention can be used with servo, mechanical, and hydraulic presses, and can optionally replace an existing air or pneumatic cushion; however, this is not required. Dependent on the type of application, some installations can be done without the need of making an expensive pit under the press. In this regard, pits are generally dug out underneath the press in order to gain more linear height for the cushion to sit in. In one non-limiting embodiment, the variable pulsating, gap control, auto-learning press cushion device of the present invention can be much shorter and therefore require less overall height in most applications. In addition, the shorter height of the variable pulsating, gap control, auto-learning press cushion device of the present invention also optionally allows for the device to be installed more quickly and more cost effectively.

According to one non-limiting aspect of the present invention, a variable pulsating, gap control, auto-learning press cushion device is optionally associated with a HPU and a HMI. Generally, the HPU is necessary for supplying oil to the cushion as well as cooling it as it becomes hot from the heat generation created from squeezing oil through several small valves or orifices. An optional pump on the HPU can supply an accumulator with oil in which the accumulator supplies oil to the cushion assembly. An optional reservoir on the HPU can hold enough fluid to keep the system supplied. The HPU can also optionally provide an electrical cabinet containing all controls and electrical hardware for the cushion.

In operation, an operator can communicate with the cushion device of the present invention through an HMI and cycle any major function (e.g., bleeding the system, manually moving the cushion up and down, programming a part recipe, starting and stopping programs, etc.) of the system; however, this is not required. Here, the "part recipe" can become the target in the controller; however, this is not required. Generally, an operator can enter a desired force specific to the contact position or when the upper die first contacts the binder. From there, the operator can program one or more additional force change positions. The next force change position should be any value less than zero and the force associated with that position can either be greater, less than, or equal to the previous force entered. As long as the force falls within the limits of the device, the set force would be acceptable. The next force change position could optionally be less than the previous force change but still within the operating limits of the device. Again, the force associated with that position can be greater, less than, or equal to the previous force entered. The same sequence would be true for the next one or more force change positions optionally programmed by the operator.

According to one non-limiting aspect of the present invention, a variable pulsating, gap control, auto-learning press cushion device optionally comprises a manifold assembly, a transfer plate assembly, and mounting hardware to the press; however, this is not required. Generally, pressure in a press cushion manifold is generated by fluid moving through the proportional relief valve wherein the said fluid is moved by cylinders compressing and/or expanding. The cylinders in the manifold can be in contact with a guided transfer plate; however, this is not required. The transfer plate can be removed and the cylinders be position directly in contact with the transfer pins. Generally, a user can mount the device under the bolster of a press where a traditional air cushion would otherwise be mounted; however, this is not required.

In use (as seen in FIG. 1), transfer pins can go through holes in the bolster and contact a transfer plate and a die can optionally be set in the press wherein the transfer pins can be in contact with a binder in the die. With continued reference to FIG. 1, as the press slide descends, contact between the binder and upper die can eventually be made and the transfer pins can transfer force from the cushion to the binder. As the press continues to descend, pressure can force the oil in the manifold to move through the proportional relief valve; however, this is not required. Pressures can be adjusted according to what is programmed in the controller. Optionally, a pressure sensor can be located in the manifold that can monitor pressure during the stroke of the cushion wherein the pressure sensor can subsequently feed information back to the controller where adjustments to the spool position in the valve can be made for the purpose of matching the feedback with the target. As such, a linear position measuring device can be connected to the transfer plate to provide optional feedback position to the controller; however, this is not required.

According to one non-limiting aspect of the present invention, the variable pulsating, gap control, auto-learning press cushion device can utilize force control or position control such that the position feedback can be used to signal the controller when to adjust to a different force and also for return and delay purposes; however, this is not required.

The addition of a pulsing effect of the variable pulsating, gap control, auto-learning press cushion device of the present invention can add significant benefit to the lubrication and friction factor. In this regard, pulsing allows for adhesion to be reduced between the blank material and the upper and lower die surfaces; however, this is not required. Although this alone can result in reduced friction, it also optionally allows for the lubrication layer to be redistributed thereby creating a lower and more consistent coefficient of friction.

Referring now to FIGS. 1-10, there is illustrated various non-limiting aspects of the variable pulsating, gap control, auto-learning press cushion device in accordance with the present invention. The variable pulsating, gap control, auto-learning press cushion device of the present invention is compatible with being installed in traditional metal stamping presses; however, it can be appreciated that the variable pulsating, gap control, auto-learning press cushion device can be configured to a wide variety of metal stamping presses (e.g., mechanical, servo, hydraulic, etc.).

FIG. 1 is a schematic representation illustrating a general layout of the variable pulsating, gap control, auto-learning press cushion device according to one non-limiting aspect of the present invention. As can be appreciated, the device is configurable such that some components within the assembly can be excluded from some configurations and/or included in others.

Additionally, one non-limiting embodiment of the variable pulsating, gap control, auto-learning press cushion device of the present invention can be incorporated into servo, mechanical, and/or hydraulic presses; however, this is not required.

According to another or alternative non-limiting embodiment of the present invention, a cushion assembly optionally comprises a transfer plate 1, a manifold assembly 2 that contains one or more hydraulic cylinders HC, a pressure transducer 3, a linear position transducer 7, and a hydraulic circuit 4; however, this is not required. The cushion assembly can be optionally mounted to the underside of a press bolster 8.

Hydraulic circuit 4 can optionally be configured by the user. Generally, hydraulic circuit 4 optionally includes one or more common valves and hoses and can be configured with one or more pumps and/or one or more motors; however, this is not required. Hydraulic circuit 4 can also optionally be used with an electro-proportional valve for the purpose of generating force in the press cushion. By regulating the flow of fluid from a lower chamber LC of the one or more hydraulic cylinders HC, movement of the transfer plate 1 or other cushion platform of the cushion assembly 2 can be controlled.

In application, one or more dies can be used to draw or form different sheet metal components that can be used in at least automotive, commercial, and recreational applications. With further reference to FIG. 1, an upper die 11 can be mounted to press slide 10. Traditionally, the press slide is a dynamic moving component of any press and can be adjustable in both position and/or velocity. As such, the position of press slide 10 can be communicated with a controller 6 via a linear position transducer 9 mounted to press slide 10 or by some other means; however, this is not required.

A lower die 14 can be mounted to the top surface of bolster 8; however, this is not required. Traditionally, the bolster is made of a rigid material and is often a static or non-moving component of any die press. Lower die 14 can have a binder 12 for the purpose of holding a blank material that is to be formed; however, this is not required.

In use, upper die 11 can come into contact with binder 12 when the press slide 10 descends; however, this is not required. In operation, binder 12 can have a force applied to it by cushion transfer plate 1 by transferring force using transfer pins 13. As such, binder 12 is optionally provided for the purpose of applying a clamp force to the material to restrict the flow of the material in the die; however, this is not required. In this regard, a force too large can cause the material to pull too tight, which can cause the material to yield in tension. Similarly, a force too small can cause the material to not be pulled enough, which can cause for the material to yield in compression.

With continued reference to FIG. 1, an operator can optionally communicate with controller 6 via HMI 5. Depending on the configuration, the operator can enter a "part recipe" corresponding with the type of system they are using; however, this is not required. A "part recipe" can include several different set points at which force can be changed.

In operation, when transfer plate 1 is at the top of its stroke, a controller 6 can give feedback to linear position transducer 7, providing information that its position is now zero; however, this is not required. Optionally, the programmed position set points can be any value less than, greater than, or equal to zero. As can be appreciated, other or alternative numerical scales can be used. At each set point, a force is optionally entered that corresponds with that position. As such, a force value can also be entered for initial contact, or "zero" position.

As press slide 10 descends and makes contact with binder 12, the cushion can begin to build pressure until it reaches an initial contact force value; however, this is not required. As the cushion reaches the initial contact force value, it can begin to stabilize until press slide 10 continues to descend and until the feedback from the linear position transducer 10 on transfer plate 7 signals the controller 6 that a next set point has been reached. As the next position is reached, the cushion can relieve pressure or increase pressure depending on whether the force entered is increasing or decreasing from the contact force. As such, it can approach stabilization until the next set point is reached. As used herein, the term 'cushion platform' includes any component of the cushion assembly configured to move in response to pressure applied thereto by the press slide 10.

At the bottom of a stroke, transfer plate 1 can be delayed such that it would hold a particular position for a specified amount of time before ascending again; however, this is not required.

Figure 4:
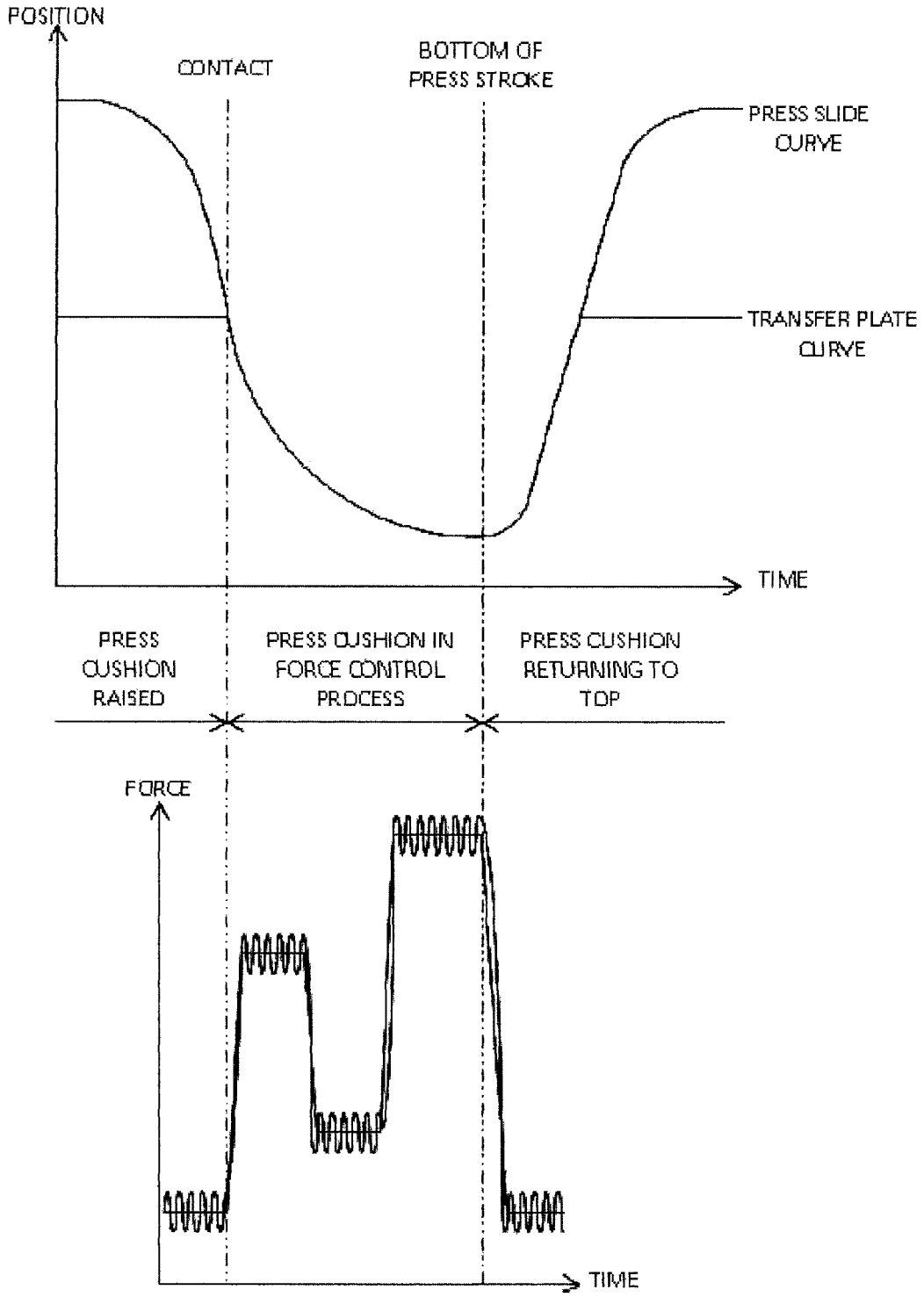
FIG. 4 is a combined graph wherein the top graph shows the position of a press slide and the transfer plate over time throughout the stroke of the press, and wherein the bottom graph illustrates the force produced by the cushion during the working stroke according to another non-limiting aspect of the present invention.

The linked graphs in FIG. 4 illustrate the effects of the cushion device. The top graph illustrates the position of a press slide and a transfer plate over time though one full stroke of the press. The bottom graph illustrates the force produced by the cushion during the working stroke of the top graph.

With continued reference to the top graph in FIG. 4, as the press slide begins to descend, the transfer plate remains static; however, this is not required. Over time, the press slide descends far enough to a point where contact is made between the upper die attached to the press slide and the lower binder linked with the transfer plate of the cushion device. At this point, the upper die and the binder remain in contact through the stroke until the transfer plate reaches the top of its stroke; however, this is not required. Here, the press can then continue to ascend to the top of its stroke. While the upper die and the lower binder are in contact through the working stroke, the cushion can be in the force control process; however, this is not required.

With reference now to the bottom graph in FIG. 4, an illustration of a force curve during the stroke of the press is provided. As illustrated in FIG. 4, the force can change at different positions throughout the stroke of the press; however, this is not required. As can be appreciated, any configurable force change that falls within the limits of the device can be acceptable. The pulsing of the force during the stroke can also be seen in the bottom graph in FIG. 4.

The pulsing force of the variable pulsating, gap control, auto-learning press cushion device of the present invention can reduce the average force required to produce a part; however, this is not required. The pulsating effect of the present cushion device provides several unique advantages such as by reducing the average force required to produce a part, thus savings on tonnage required of a press are incurred, which in turn provides additional advantages such as lengthening the life of the press as well as allowing for better part formation. In addition, the pulsating effect of the present press cushion device permits material to flow better in die stamping applications; however, this is not required.

Figure 2:
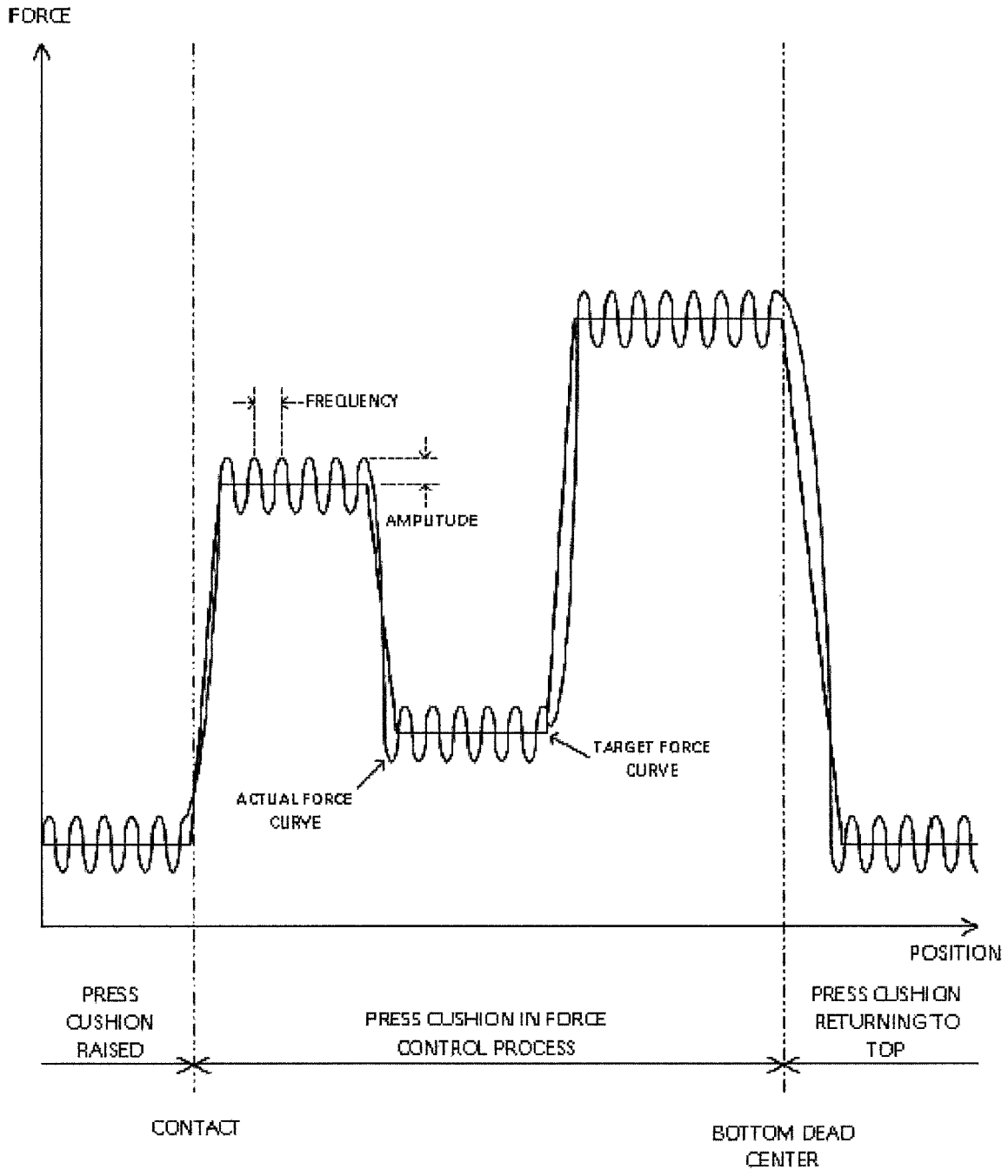
FIG. 2 is a graphical illustration demonstrating the pulsing force of a press cushion device according to another non-limiting aspect of the present invention.

FIG. 2 is a graphical illustration demonstrating the pulsating force of the press cushion device according to one non-limiting aspect of the present invention. Here, controller 6 can generate a target curve based on operator input values through the HMI 5; however, this is not required. As the press descends and the upper die 11 makes contact with the binder 12, fluid can begin to be pushed through an electro-proportional valve. As such, the optional electro-proportional valve can adjust opening and closing to permit or restrict fluid movement; however, this is not required. This optionally controls the pressure in the device, which can result in a controlled force; however, this is not required.

The pressure can be translated into force from a simple pressure force equation where force can be equal to pressure divided by area. The area can be derived from the sum of the hydraulic piston areas used in the manifold.

Figure 7:
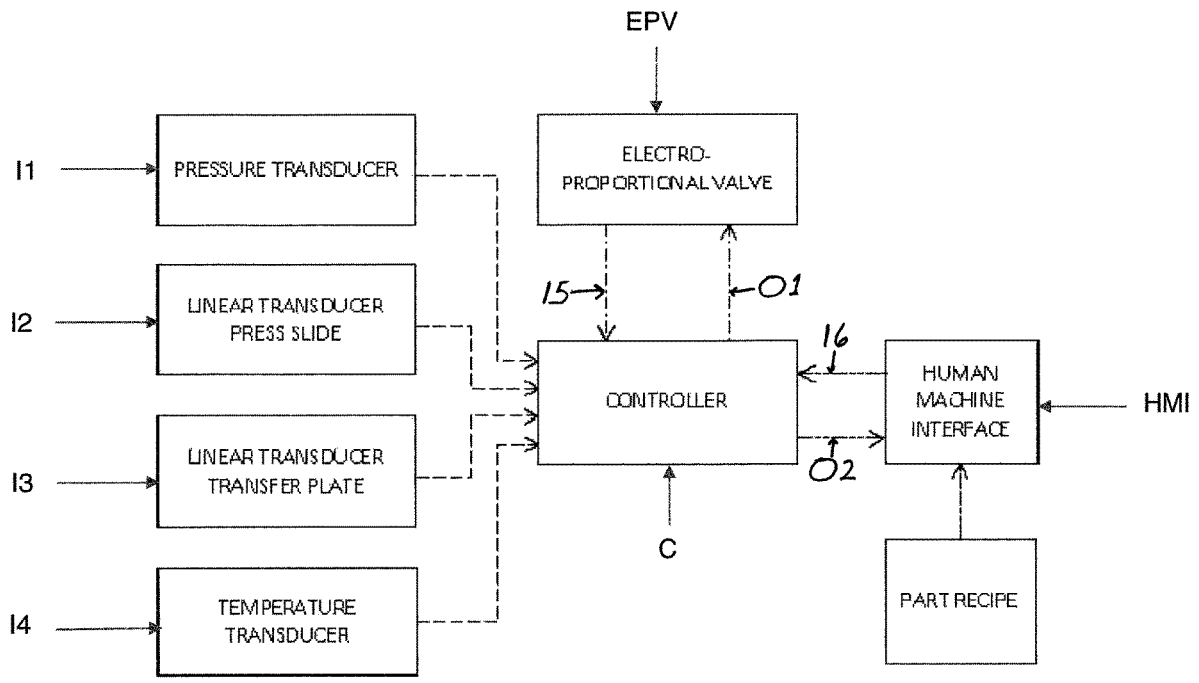
FIG. 7 is an illustrative flow chart illustrating the inputs and outputs of a controller used in another non-limiting aspect of the present invention.

Referring now to FIG. 7, a general flow chart of all the inputs I1, I2, I3, I4, I5, I6 and outputs O1, O2 to the controller in the press cushion device is provided. However, it is to be appreciated that the press cushion device is not limited by the configurations provided on this flowchart. As can be appreciated, other or alternative inputs and outputs to the controller can be used. In one non-limiting aspect of the present invention, the pressure transducer and transfer plate linear transducer can be primary feedback; however, this is not required. The data feedback provided by these two devices (the pressure transducer and the transfer plate linear transducer) are what generated the graph illustrated in FIG. 2.

The pulsating effect of the cushion can be induced by a programmed curve inside the controller; however, this is not required. The curve can be adjustable with the programmed force (i.e., the pulsing frequency can be carried out with all the force changes throughout the stroke of the press). As such, the force curve can be controlled; however, this is not required.

In one non-limiting method of control, an operator can enter target force values into the controller wherein the controller can adjust the valve in order to achieve the programmed setting; however, this is not required. During these force changes and stabilizations, the curve can oscillate. As can be appreciated, this oscillation is an effect of the programming of the curve within the controller and the curve is automatically adjusted based on the values entered.

Another or alternative non-limiting method of control utilizes gap control wherein an operator does not enter any specific forces, yet the controller changes forces based on feedback calculations. As can be appreciated, the gap control method eliminates the need of programming, which reduces the amount of tryout time as well as any operator input error.

Referring again to FIG. 2, the graph illustrates a target force curve along with an actual force curve. As seen in the graph of FIG. 2, the target force curve does not pulse like the actual force curve; however, this is not required. A frequency and amplitude can be entered into the controller to add in the pulsing motion. In one non-limiting embodiment of the present cushion device, the controller can seek to follow the target curve and the dithering effect of the actual curve can be optionally controlled by an independent variable; however, this is not required.

According to one non-limiting aspect of the present invention, the frequency and amplitude can be set by the operator to manipulate and change to satisfy results; however, this is not required. Thus, the variable pulsating, gap control, auto-learning press cushion device can be used for a wide variety of applications. As can be appreciated, a smaller frequency and amplitude can result in more of a resonance which can lead to a lower force required to form. Similarly, a larger frequency and amplitude can result in less die adhesion which can lead to better material flow. However, when a larger frequency and amplitude are used, the electro-proportional valve can become unstable. In view of this disadvantage, a limit can be place on the control to eliminate the chance of the valve going unstable during operation; however, this is not required. As can be appreciated, this method of control does not require a linear transducer on the press slide.

Figure 3:
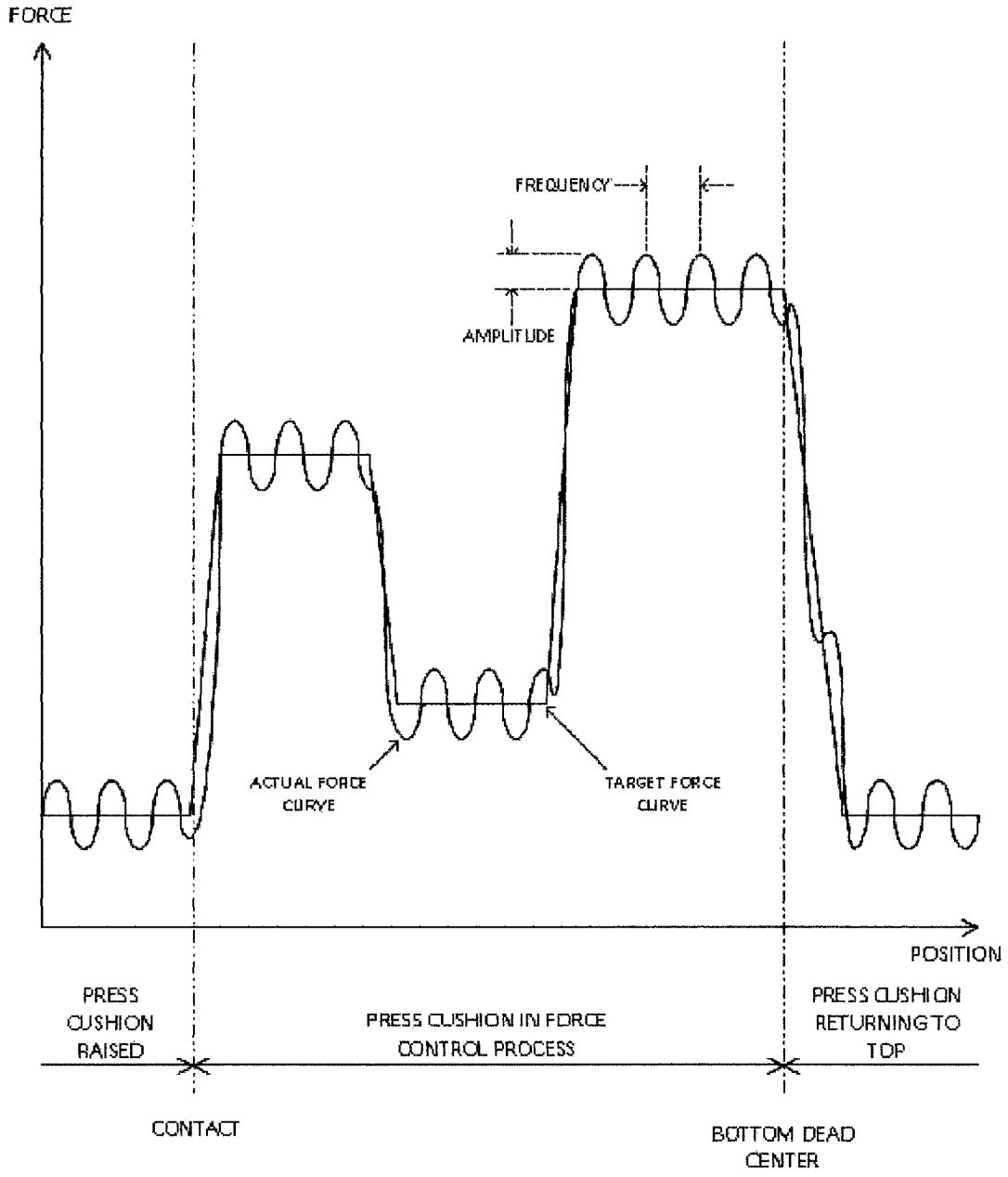
FIG. 3 is a graphical illustration demonstrating the pulsing force of a press cushion device according to another non-limiting aspect of the present invention.

Referring now to FIGS. 2 and 3, FIG. 2 demonstrates an example wherein a higher frequency and lower amplitude are used and FIG. 3 demonstrates an example wherein a lower frequency and higher amplitude are used.

Another method of gap control can be used in conjunction with the pulsing variable force control of the press cushion device; however, this is not required.

Figure 9:
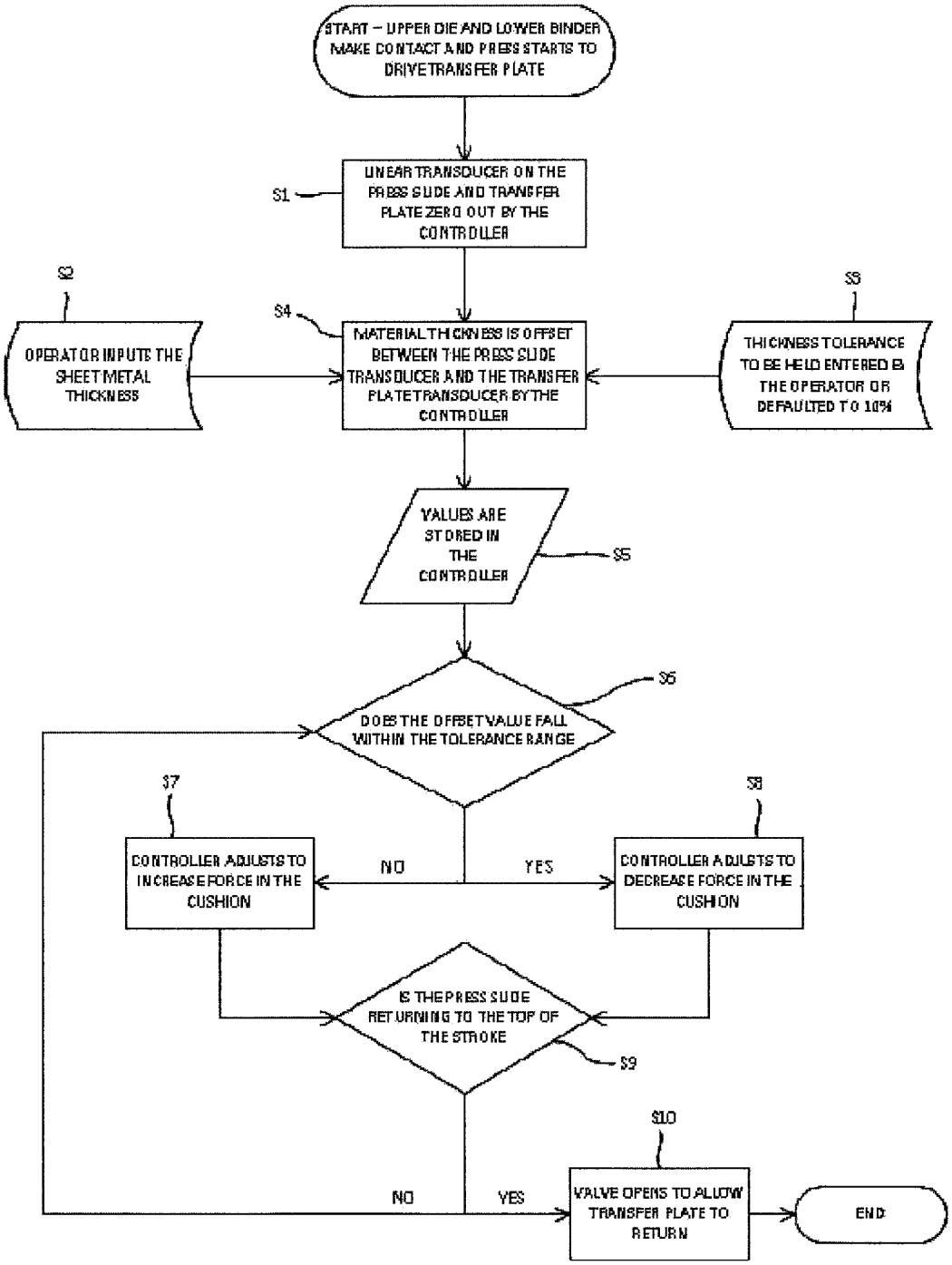
FIG. 9 is an illustrative flow chart illustrating the gap control method functions used in one non-limiting embodiment of the present invention.

Referring now to FIG. 9, a process flow chart illustrates an optional function of the gap control method using one non-limiting embodiment of the present invention is provided. Generally, the gap control process starts by the upper die and the lower binder making contact as the upper slide descends. In addition, a first method and a second method of measurement are traditionally necessary for use of the gap control method. According to one non-limiting aspect of the present invention, a first method of measurement is provided by the position of the upper slide and a second method for measurement is provided by the transfer plate; however, this is not required. As can be appreciated, other or additional components can be measured.

At contact, feedback from these two devices can be "zeroed" in the controller at S1; however, this is not required. As can be appreciated, this value can be any number set by the controller. Material thickness can then be accounted for and from this value, entered at S2; however, this is not required. Similarly, a tolerance can optionally be generated to how much the position feedbacks can deviate from each other S3; however, this is not required. Material thickness is offset between the press slide transducer and the transfer plate transducer by the controller at S4; however, this is not required. These tolerance values can be stored in the controller at S5; however, this is not required. As the press slide continues to descend and drives the transfer plate down, the force can drop until the position feedbacks fall out of tolerance S6. At this point, the controller can adjust the valve settings to increase force in the cushion in order to close the gap back into tolerance S7.

After the gap falls back into the tolerance range, the controller can then begin to adjust the valve to relieve pressure S8 until the gap falls out of tolerance again. This loop can repeat one or more times until the condition to return the cushion to the top of the stroke is satisfied at S9; however, this is not required. To sense that the cushion needs to return, the feedback from the press slide position can be used. When the velocity changes directions, the press begins to ascend, signaling the cushion to do so as well S10. The program can then loop back to the beginning or end depending on the operator preference; however, this is not required.

The tolerance of the gap can be programmed to automatically adjust throughout the stroke of the press for the purpose of accounting for normal thickening that takes place during the formation and drawing of materials; however, this is not required.

Figure 5:
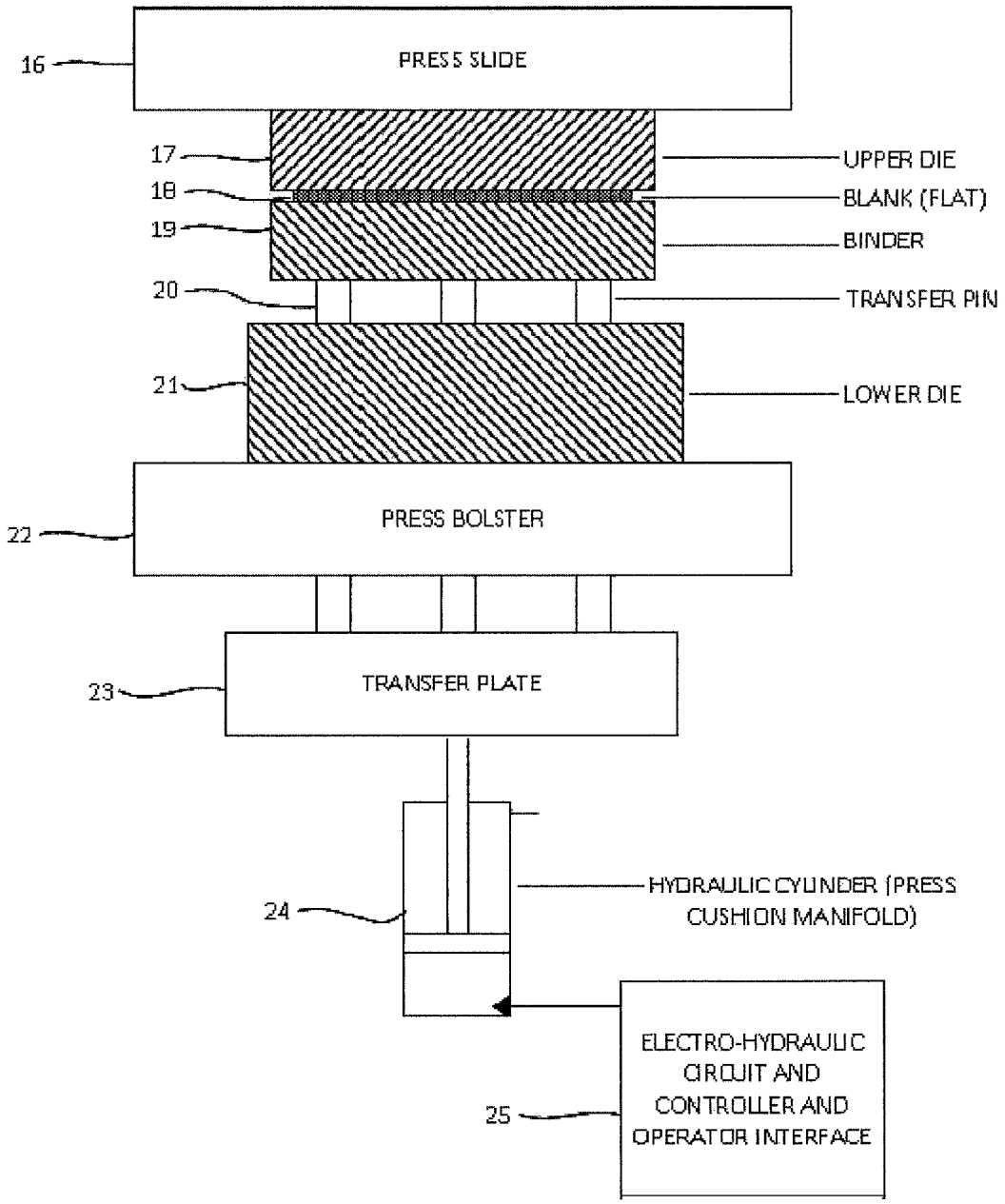
FIG. 5 is a perspective illustration of a stamp die clamping a part according to another non-limiting aspect of the preset invention.

FIG. 5 is a perspective illustration showing a stamping die clamping a substantially flat blank material. The upper die 17 can come into contact with the blank 18 which can be in contact with binder 19. Upon contact, the blank can be flat unless preliminary forming has taken place on the part without the part being held firmly. Transfer pins 20 can contact the transfer plate 23 and optionally drive it down throughout the stroke. A press slide 16, lower die 21, press bolster 22, transfer plate 23, hydraulic cylinder 24 and electro-hydraulic circuit and controller and operator interface 25 are also shown.

Figure 6:
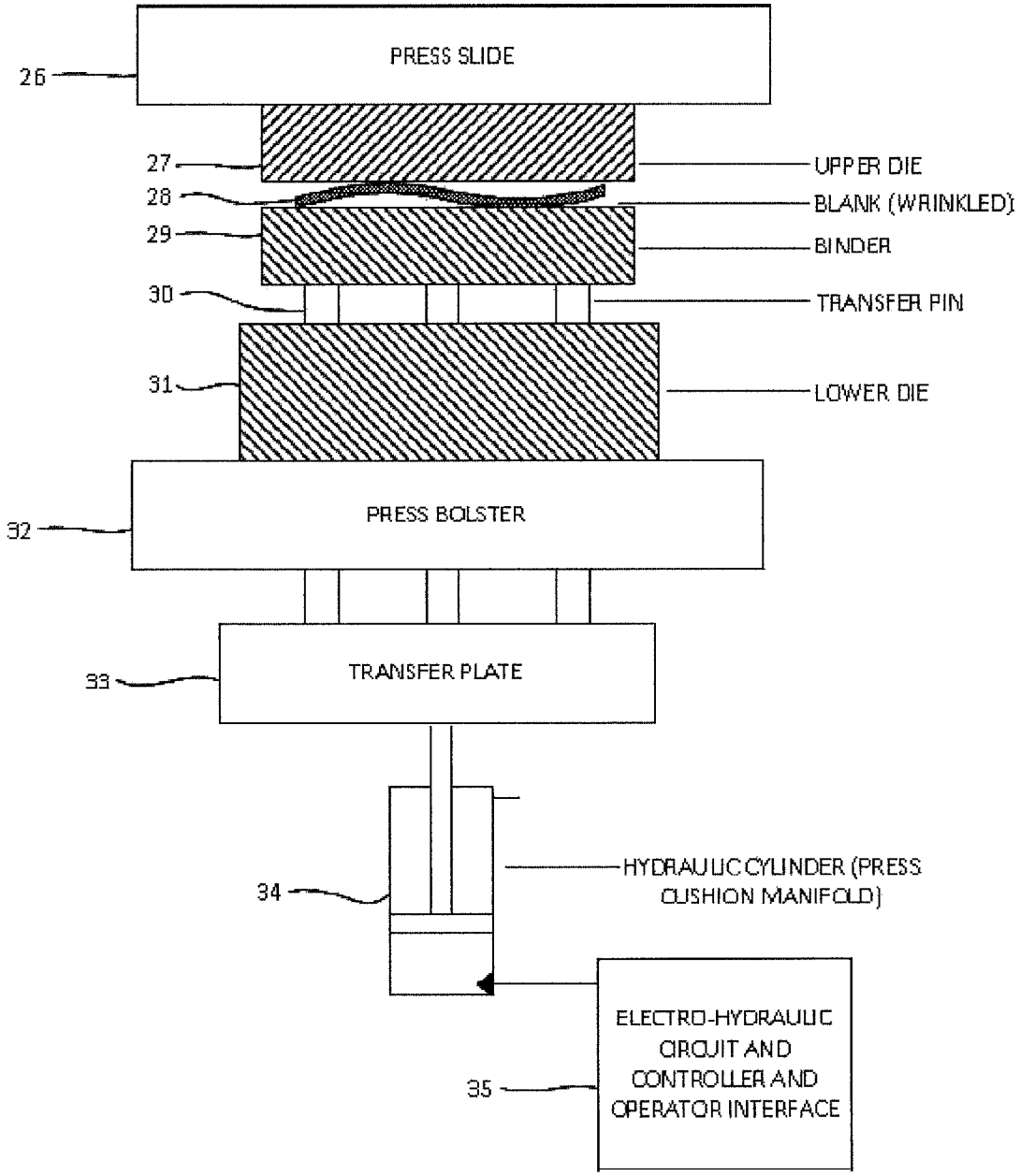
FIG. 6 is a perspective illustration of a stamp die clamping a part, the purpose of which is to illustrate the gap control method used by the press cushion device according to another non-limiting aspect of the present invention.

FIG. 6 is a perspective illustration showing the same schematic as FIG. 5, but with a wrinkled blank replacing the flat blank seen in FIG. 5. Generally, blank material tends to wrinkle when not enough force is applied to hold the material. If insufficient force is applied to the binder from the cushion, then the material can have less holding force and less restrictive force. This, along with part geometry, can cause the edges of the material to wrinkle. As can be appreciated, after the material wrinkles, it can be very difficult to flatten it out. FIG. 5 illustrates a press slide 26, upper die 27, wrinkled blank 28, binder 29, transfer pin 30, lower die 31 press bolster 32, transfer plate 33, hydraulic cylinder 34, and electro-hydraulic circuit and controller and operator interface 35.

Having the proper thickness tolerance is desirable to the operation of the gap control method. As a part is drawn, the blank perimeter can shrink in length as material is flowed over the punch. This results in the flange around the part (blank perimeter) to thicken. Just as material thins when it is stretched, it also thickens when it is compressed. The thickening of a part should be taken into effect when running the cushion in gap control method as the system could undesirably confuse material thickening to a wrinkle and increase the force rapidly if the tolerance is not kept within the proper boundaries. The wrinkle thickness of the part can be noticeably thicker than a thickened part; however, this is not required.

Figure 10:
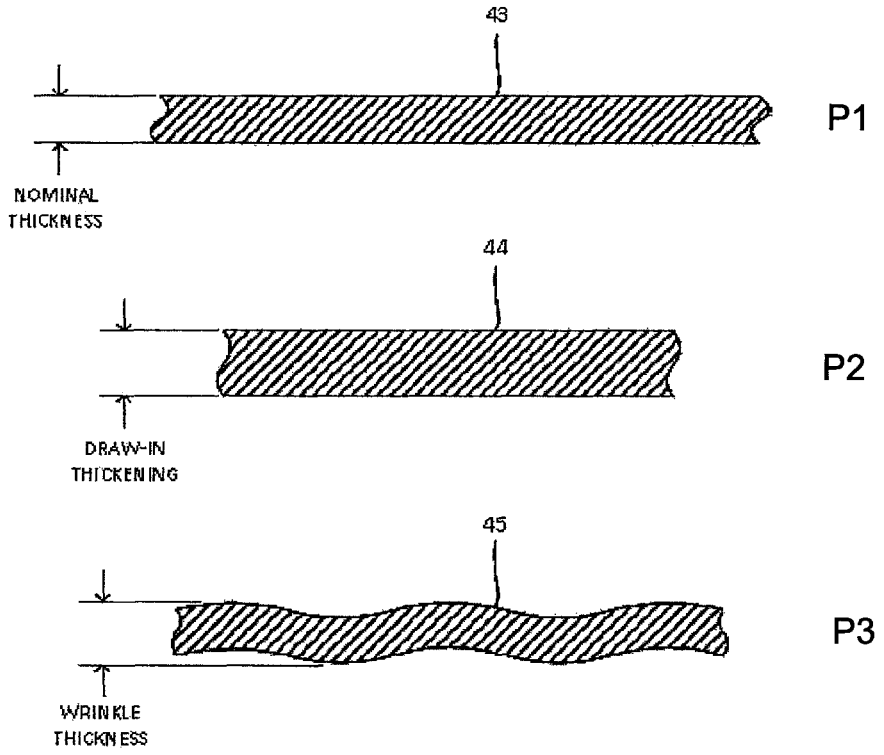
FIG. 10 is a perspective illustration demonstrating blanks of different thicknesses for the purpose of illustrating the gap control concept according to another non-limiting embodiment of the present invention.

FIG. 10 demonstrates the general difference between a part thickening 44 shown in P2, and nominal material thickness 43 shown in P1, and a wrinkled part thickness 45 shown in P3. As seen in FIG. 10, there can be little difference between the thickness of a thickened part and a wrinkled part if the wrinkle takes place early enough in the stroke. One non-limiting advantage of the gap control method is the tolerance can be adjusted through the stroke. Thus, when programming for the gap control method, the characteristic thickening of material as the draw gets deeper can be taken into consideration. As such, tolerance can gradually increase throughout the stroke but not enough to where the part can wrinkle; however, this is not required.

The gap control method can yield the best possible result with non-conventional methods of sheet metal forming. A part can potentially still wrinkle or split due to geometry or material properties. According to one non-limiting aspect of the present invention, the novel press cushion device can compensate to the best possible part in the current operating conditions. Other factors (e.g., die surface finish, lubrication, machining tolerances, temperature, etc.) can also add significant effects to the formability of the part.

With further reference to FIG. 7, optional control inputs and outputs for operation of the gap control method are provided. As can be appreciated, other or additional inputs and outputs can be used. The inputs can be from the linear position transducer on both the press ram and the transfer plate; however, this is not required. The other input can be a pressure transducer located on the cushion manifold and a temperature sensor also located on the cushion manifold; however, this is not required. The pressure transducer can monitor the pressure in the cushion during the stroke of the press. This pressure is optionally fed back to the controller. In non-limiting embodiments, a 4 to 20 milliamp (mA) signal can be used (and all values and ranges therebetween); however, this is not required. The pressure sensor can be setup in the control to correlate the 4 to 20 mA signal to the actual pressure reading; however, this is not required. Similarly, the temperature sensor can be set up in the same regard; the temperature range of the sensor can be correlated to a 4 to 20 mA signal. This temperature reading can trigger the heat exchanger to turn on and off as oil temperature rises; however, this is not required. The oil temperature can rise due to heat generation due to energy losses from oil squeezing through a small orifice (electro-proportional valve). The temperature sensor can also fault out the cushion if the temperature continues to rise and exceeds the maximum programmed value. The linear position transducers on both the press ram and the transfer plate can also be set up similarly to the pressure and temperature sensors; however, this is not required. The position and range of the linear transducer can be correlated to a 4 to 20 mA signal that the controller can read and determine the positions of both the press slide and the transfer plate; however, this is not required.

With continued reference to FIG. 7, other or additional non-limiting inputs to the control can come from feedback from the electro-proportional valve and also the HMI; however, this is not required. The operator can input different "part recipes" or change or create new recipes. These modifications can be communicated to the controller which can actively update; however, this is not required. The controller can also feed the HMI with real time data received from the transducers on the cushion assemble including temperature, pressure, and position; however, this is not required. The electro-proportional valve can optionally control the force and/or pressure in this system. However, each proportional valve can require the proportional-integral-derivative (PID) values be tuned in order for the valve to have maximum performance; however, this is not required. These PID values can greatly affect the ability of the cushion to change forces rapidly, smoothly, and accurately. Optionally, there can be a spool located within the valve that oscillates back and forth based on input voltage given from the controller; however, this is not required.

The controller can be programmed to give certain feedback based on the type of input and target; however, this is not required. For example, the voltage can be adjusted to the valve such that it can move the spool to a specified position; however, this is not required. Thus, adjusting the valve can effectively change the orifice size that the oil runs through. By opening the valve, more oil can be permitted to flow through thereby decreasing the pressure in the cushion. In contrast, by closing the valve, oil flow through the valve can be restricted which can result in an increase in pressure/force.

In use, oil can be pushed through the electro-proportional valve by the press moving downward and driving the oil through the electro-proportional valve; however, this is not required. In this regard, the cushion assembly also optionally comprises one or more hydraulic cylinders which can be directly driven by a transfer pin or can work as a unit against a transfer plate that is optionally being driven down by transfer pins; however, this is not required. As such, the fluid has no alternative exit except to exit through said electro-proportional valve. Generally, this is the principle behind the force control method of the present invention; the pressure in the manifold can be controlled because it only has one path out (except for a relief valve that can be present for safety purposes) through the electro-proportional valve.

As previously described, two other or alternative methods or means for measuring and monitoring position of the cylinders or transfer plate can be utilized in any control method; however, this is not required. The two methods of measurement described provide several unique advantages, such as the reduction in space required for installation and cost and installation time and constraints.

Figure 8:
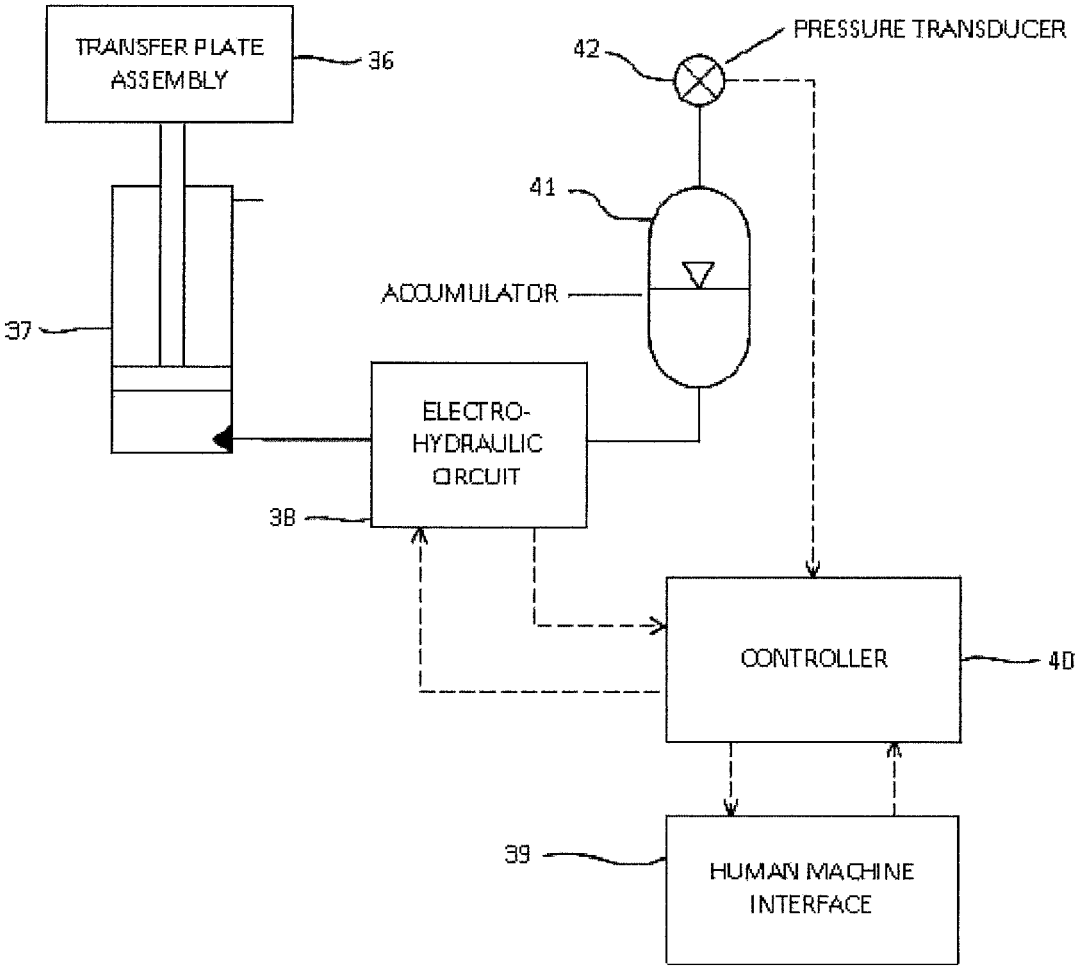
FIG. 8 is a perspective illustration demonstrating the press cushion device used as a regenerative device using an accumulator to collect oil according to another non-limiting embodiment of the present invention.

FIG. 8 illustrates one non-limiting configuration of a press cushion device according to one aspect of the present invention, wherein an optional accumulator 41 with a pressure sensing device 42 on the nitrogen charged end of the accumulator 41 is provided. As understood from FIG. 8, as fluid is optionally driven through the hydraulic circuit 38 by the hydraulic cylinder 37, it can fill up the accumulator 41, resulting in an increase in pressure rise and can be correlated with the volume change in the system which can then be used to optionally back calculate the position of the transfer plate of the transfer plate assembly 36; however, this is not required. However, one disadvantage of this method over using a linear position transducer is that the pressure reading can be very noisy, which can lead to some undesirable variance between actual position and calculated position. Thus, for some systems not requiring a precise position (i.e., those systems with a wider tolerance), this method of measurement can be a good economical choice.

Another or alternative non-limiting method of measurement can be using an optional flow meter. The flow meter can optionally be located in the path between the cylinder manifold and the electro-proportional valve; however, this is not required. Depending on the configuration of the system, the data received can be noisy and supply a varied reading between actual and calculated values. However, by knowing how much fluid has passed through at any point in time, the velocity can be calculated and the position can be determined from the velocity and time calculation. Additionally, the flow meter can result in some pressure losses that can lead to the force control to be affected at lower pressures.

Although these two methods of measurement as described might not be as accurate as a linear position transducer, these methods can be a more economical choice for systems that do not required such accuracy.

Sheet metal simulation software can be effective in simulated real world stamping applications. Here, the simulation data can optionally be directly outputted to a controller through a HMI 39; however, this is not required. A controller 40 can optionally read the data and be able to match the same curve generated in the sheet metal simulation. As such, the present method using sheet metal simulation software can be effective in reducing tryout time and increasing part quality. However, this method can be limited by extraneous variables (e.g., material properties used in simulation, actual material properties, press slide velocity, die surface conditions, lubrication, physical die geometry, etc.). However, the present non-limiting method using sheet metal simulation can be very effective and cost saving.

Generally, when using sheet metal simulation software, the data can optionally be transferred to a controller; however, this is not required. In one non-limiting embodiment of the present invention, the data can be transferred to the controller by the use of a portable USB drive, wirelessly or by some other means; however, this is not required. As can be appreciated, other types of data storage devices can be used. As such, the data transferred to the controller can be in any format recognized by the controller such that the controller can properly interpret the data. In another non-limiting embodiment of the present invention, the data can be in Excel™ column format; however, this is not required. The data can then be saved and stored as a part number in the HMI to be recalled in a future run instead of having to import data each time; however, this is not required. Using stored data in the manufacturing of a part in the future can be time effective and cost effective.

Another or alternative non-limiting method of control is for the system to automatically learn what it takes to make a part. In this regard, the controller can be programmed to record instances of pressure spikes and gap spikes, and then go back through the program to adjust variables accordingly for the purpose of producing the best part possible; however, this is not required. As can be appreciated, this can take several iterations and can still result in a part that is not completely up to the quality expectations if the part geometry is not necessarily feasible.

Generally, the method of automatic learning can work by initially placing a blank in the die, and subsequently stamping the part; however, this is not required. As can be appreciated, more or fewer steps can be involved in the drawing of a part. However, if the part were to split part way through (e.g., due to too much pressure), there can be a noticeable pressure relief spike; however, this is not required. At that point, the controller can optionally go back and adjust the force before the spike to eliminate the split (e.g., by reducing the pressure). As can be appreciated, this method can take several iterations and several part tryouts in order for the part to be obtained. Similarly, if there was a noticeable gap increase, it can be assumed that the material wrinkled, resulting in increased gap around the part. The controller can optionally calculate the location where this occurred and, for example, increase the force variable as necessary in this location; however, this is not required. In addition, this method can also be limited by traditional variables (e.g., material properties, die surfaces, repeatable lubrication methods, press velocity, etc.); however, this is not required. It should be appreciated that the method of automatic learning can include iterative adjustments to the force in response to both detected wrinkles and detected tears to generate a force profile that eliminates wrinkles or tears all else being equal (e.g., consistent blank material properties, press forces etc.)

According to one non-limiting aspect of the present invention, the variable pulsating, gap control, auto-learning press cushion device can optionally be configured to operate with or without a HPU. Instead, the device can be supplied oil from a pressurized reservoir device; however, this is not required. As such, fluid can flow through a proportional relief valve and into the reservoir where it then could optionally be supplied back to the cushion upon return of the transfer plate; however, this is not required. However, heat generation can be reduced here due to the regenerative nature of the device, but is not necessarily eliminated altogether therefore necessitating the need for an auxiliary cooling system; however, this is not required. Thus, the present invention can provide benefits of less energy consumption and losses thereby creating a more economical press cushion device.

One non-limiting advantage of the variable pulsating, gap control, auto-learning press cushion device of the present invention over previous devices is that the force can optionally be controlled and pulsated simultaneously; however, this is not required. As such, a pulsating cushion force can reduce adhesion between the blank material of the part and the surfaces of the upper die and the lower die. By reducing adhesion, the friction between the blank and the die can also be reduced thus allowing more optimum material flow; however, this is not required. In addition, the pulsating force can provide significant benefits to the lubrication layer between the upper die surface and lower die surface and the blank material of the part. Here, a pulsating cushion can reduce the average force while maintaining the maximum force required to effectively draw/form a part without wrinkling or splitting depending on part geometry and material properties. Thus, the variable pulsating, gap control, auto-learning press cushion device of the present invention provides improved quality of parts using current systems and processes; however, this is not required. Additionally, the variable pulsating, gap control, auto-learning press cushion device of the present invention can eliminate the need for further processing of parts, which results in a savings of both time and money.

Another non-limiting advantage of the variable pulsating, gap control, auto-learning press cushion device of the present invention over previous devices is the unique means of measuring linear position of the transfer plate. In this regard, the variable pulsating, gap control, auto-learning press cushion device of the present invention can optionally use pressure rise in an accumulator to back calculate for linear position; however, this is not required. However, a limitation can be possibly noisy data received in the pressure rise measurement which can cause for an inaccurate linear position reading. As such, the measurement device can be most effectively utilized on a cushion device that does not require a HPU. This method of measurement optionally omits the need for a linear measurement device to be attached to a cushion assembly. In addition, the cushion can optionally be run without a transfer plate; however, this is not required. In this situation, there can be an optional hydraulic cylinder underneath each hole in the bolster (i.e., located on top of the press bed) wherein a transfer pin optionally placed in any hole of the bolster can make contact with the hydraulic piston directly; however this is not required.

Yet another non-limiting advantage of the variable pulsating, gap control, auto-learning press cushion device of the present invention over previous devices is the type of control method available to be used in some non-limiting configurations. In this regard, the variable pulsating, gap control, auto-learning press cushion device of the present invention can optionally utilize a method of gap control in which the cushion can maintain a constant gap between the upper die and lower die throughout the stroke of the press; however, this is not required. When the upper die makes initial contact with the binder and clamps the blank material, the cushion can maintain a constant gap throughout the stroke of the press as well as optionally accommodate for thickening in material; however, this is not required. The gap control method can use the minimum force required to maintain a gap and increasing and decreasing force when necessary to maintain the gap; however, this is not required. The present method optionally permits for material gather as much as possible for the purpose of reducing the change of splitting, while still clamping the material tightly enough to reduce the change of wrinkling. In addition, the present non-limiting gap control method can optionally eliminate the need of programming which can reduce the amount of tryout time as well as any operator input error.

Still yet another non-limiting advantage of the variable pulsating, gap control, auto-learning press cushion device of the present invention over previous devices is the ability to transfer simulation data to the controller. In sheet metal manufacturing, sheet metal simulation has been a well demonstrated method of effectively simulating parts. In simulations, the binder reaction force can be calculated and the data from a said calculation can be fed into a cushion controller for the purpose of optimizing a force curve for making a part. However, this method can be limited by variables outside the simulation (e.g., die surface quality, lubrication, and actual material properties, etc.). If the actual material properties are known, the method of the present invention can be very effective. Similar to the gap control method, the present method can also reduce tryout time as well as elimination of risks from programming mistakes; however, this is not required.

Referring now to FIG. 16, a process flow chart illustrates an optional function of the auto-learning control using one non-limiting embodiment of the present invention is provided. Generally, the auto-learning control process starts by the upper die and the lower binder making contact as the upper slide descends. Testing has shown the ability of the upper die and/or cushion position/velocity/force to show when in the process the part wrinkled or split which are often undesired characteristics in the finished part.

For example, FIGS. 11-15 illustrate several graphs displaying characteristics of the upper die and/or cushion indicative of either a wrinkle or tear occurring during the process. In FIG. 11, the upper die and lower cushion positions are plotted over time. As can be seen, the slope of each line is essentially the same during an initial portion of the process. The slopes then diverge indicating that the spacing between the components has increased (e.g., the part has thickened due to wrinkling). This information can be used to make adjustments to the force profile to avoid wrinkling on future strokes of the press machine.

FIG. 12 plots the cushion pressure over time. A tear occurs at approximately 48.400 s resulting in a pressure relief spike. This information can be used to make adjustments to the force profile to avoid tearing on future strokes of the press machine.

FIG. 13 illustrates rapid die/binder separation correlating to wrinkling in the part flange. This information can be used to make adjustments to the force profile (e.g., increase force) to avoid wrinkling on future strokes of the press machine.

FIG. 14 illustrates cushion position and velocity indicative of a tear. In addition, the cushion pressure indicates a pressure relief spike indicative of a tear. This information can be used to make adjustments to the force profile to avoid tearing on future strokes of the press machine.

FIG. 15 illustrates cushion position and velocity indicative of a tear. In addition, the cushion pressure indicates a pressure relief spike indicative of a tear. This information can be used to make adjustments to the force profile to avoid tearing on future strokes of the press machine.

Returning to FIG. 16, an estimated force profile can be used throughout the cycle of a first part. If a wrinkle or split occurs, the controller can make the necessary adjustments to the force profile to try to make a subsequent part without wrinkles or splits. Accordingly, the process begins with process step S101 wherein a blank is places on the lower binder and the upper die and lower binder make contact and the press started to drive the transfer plate. At process step S112, the linear transducers on the press slide and the transfer plate are zeroed out by the controller. Alternatively or in addition, an operator may input an estimated force profile in process step S114. In process step S116, material thickness is offset between the press slide transducer and the transfer plate transducer by the controller, and the values are stored in the controller at process step S118. The press system then carries out a complete cycle in process step S120 with the upper die engaged with the lower binder and stroking the system until both components disengage one another (e.g., a press cycle).

If, in process step S121, it is determined that the part had split during the stroke, then the force can be reduced in the steps (or portions of the press cycle) leading up to the position at which the split occurred. Thus, if a split is detected at process step S120, the method proceeds to process step S122 where it is determined if the part wrinkled before the split. If yes, the method proceeds, via process step S124 to process step S126 where the controller adjusts to increase the force prior to the wrinkle occurring for the next press cycle (e.g., for forming a subsequent part). If the part did not wrinkle before it split as determined in process step S122, then the method proceeds to process step S128 where the controller adjusts to decrease force prior to the split occurring for the next press cycle (e.g., for forming a subsequent part).

It should be understood that if no split or tear has been determined in process steps S121 and S124, respectively, the method proceeds from process step to process step S130, bypassing process steps S122, S126 and S128. Likewise, after any adjustment of force in process steps S126 and/or S128, the method proceeds to process step S130. In process step 130, it is determined whether the press slide is returning to the top of the stroke. If yes, then the method proceeds to process step S132 and the valve opens to allow the hydraulic cylinder to return the cushion platform. If no, the method reverts to process step S121. The controller can continue to make pressure adjustments until the desired force profile is reached or if no splits or wrinkles have occurred. The operator can override any of the controller generated set points, however, this is not required.

Controller adjustments made to the force profile after forming a first part are then used to form a second part. As will be appreciated, the force adjustments, over time, tend to reduce and/or eliminate malformation of parts.

Turning now to FIG. 17, a cross-section of an exemplary cushion assembly attached to a press bolster is illustrated. The cushion assembly generally comprises a manifold 50 supporting a plurality of hydraulic cylinders 52 operatively coupled to a transfer plate assembly 54. Guide pins 56 guide vertical reciprocating movement of the transfer plate assembly 54. A servo block 60 and servo valve 62 control the flow of fluid from the hydraulic cylinders 52.

The particular reference has been described with reference to a number of different embodiments. It is to be understood that the invention is not limited to the exact details of construction, operation, exact materials or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

What is claimed:

1. A die press device for a press machine for forming a blank comprising:

an upper press assembly, said upper press assembly including a press slide and an upper die connected to said press slide;

a cushion platform, said cushion platform including a transfer plate, a bolster positioned at least partially above an upper surface of said transfer plate, a lower die positioned on an upper surface of said bolster, a plurality of transfer pins positioned between a top surface of said lower die and a bottom surface of a binder, a top surface of said binder configured to support the blank;

at least one hydraulic cylinder supporting at least a portion of said cushion platform, said cushion platform configured to move in response to a force applied thereto by said upper press assembly;

a control valve configured to permit flow, restrict flow, or combinations thereof of hydraulic fluid from a chamber of said at least one hydraulic cylinder; and;

a controller, said controller communicating with a) an upper press position indicator that indicates a positioned of one or more components of said upper press assembly, and b) a cushion platform position indicator that indicates a positioned of one or more components of said cushion platform; said controller configured to selectively open, close, or combinations thereof said control valve to maintain a minimum pressure in said chamber of said hydraulic cylinder to thereby control movement of said cushion platform when said upper press assembly applies a force thereto;

wherein said controller is operative to control said control valve to vary a value of said minimum pressure during a working stroke of said press machine;

wherein said controller includes first and second control values that are used to control said control valve based on position information received from said upper press position indicator, said cushion platform position indicator, or combinations thereof, wherein said controller is configured to a) determine a thickness of the blank upon detection of contact of said upper press assembly with the blank, b) calculate whether the thickness of the blank is within a thickness tolerance of a preset thickness value, c) cause increased pressure to be applied by said least one hydraulic cylinder supporting at least a portion of said cushion platform when the thickness of the blank is not within the thickness tolerance, and, wherein said controller is configured to A) monitor conditions of said die press device during a stroke of said press machine forming the blank using a first force profile, said monitored conditions including at least one of a position of said cushion platform of or a pressure applied by said at least one hydraulic cylinder; B) analyze said monitored conditions to detect occurrence of defect in the formed blank selected from the group consisting of wrinkling of the formed blank and tearing of the formed blank and, C) altering at least one parameter of said first force profile when a defect is detected by said controller to reduce recurrence of said defect when processing a subsequent blank, and, wherein said controller causes a pulsating frequency force and a variable force to be applied to the blank during the pressing of the blank.

2. The die press device of claim 1, wherein said controller is operative to control said control valve to pulse a pressure in said chamber of said at least one hydraulic cylinder.

3. The die press device of claim 2, further comprising a Human Machine Interface (HMI) wherein an operator can enter a pulse width frequency for said pressure of said hydraulic fluid, and said controller is operative to actuate said control valve to achieve a pulse width frequency of said hydraulic fluid.

4. The die press device of claim 3, wherein said pulse width frequency can be communicated to said controller in which pressure remains as programmed yet said pulse width frequency can be changed based on any value entered in said HMI.

5. The die press device of claim 3, wherein the operator can enter a pulse width amplitude through use of said HMI and said controller is operative to actuate said control valve to achieve said pulse width amplitude of said hydraulic fluid.

6. The die press device of claim 5, wherein said pulse width amplitude is communicated to said controller in which pressure remains variable or constant and said pulse width amplitude is changed based on any value entered in said HMI.

7. The die press device of claim 1, wherein said controller is configured to control a gap between said upper press assembly and said cushion platform based at least in part on feedback from said upper press position indicator, said cushion platform position indicator, or combinations thereof by selectively opening, closing, or combinations thereof said control valve.

8. The die press device of claim 7, wherein said controller is configured to adjust said pressure of said hydraulic fluid via said control valve based at least in part on variations in said gap between said upper press assembly and said cushion platform during a stroke of said press machine.

9. The die press device of claim 1, further comprising an accumulator for receiving pressurized fluid from said at least one hydraulic cylinder, wherein a position of said cushion platform can be calculated from a pressure rise in said accumulator.

10. The die press device of claim 1, further comprising a flow rate sensor configured to sense flow rate from said at least one hydraulic cylinder, wherein a position of said cushion platform can be calculated using said flow rate sensor.

11. The die press device of claim 1, further comprising a hydraulic power unit including a pump and motor for supplying pressurized fluid to said at least one hydraulic cylinder.

12. The die press device of claim 1, further comprising an accumulator for storing pressurized fluid when said cushion pad is displaced by said press slide, said stored pressurized fluid available for returning said cushion pad.

13. The die press device of claim 1, wherein said controller is further configured to learn force profiles and store them in a HMI to be recalled in a future.

14. A method of controlling a press cushion device of a press, wherein said method comprises:

providing a die press device for a press machine comprising:

an upper press assembly, said upper press assembly including a press slide and an upper die connected to said press slide;

a cushion platform, said cushion platform including a transfer plate and a lower die;

at least one hydraulic cylinder supporting at least a portion of said cushion platform, said cushion platform configured to move in response to a force applied thereto by said upper press assembly;

a control valve configured to permit flow, restrict flow, or combinations thereof of hydraulic fluid from a chamber of said at least one hydraulic cylinder; and;

a controller, said controller configured to selectively open, close, or combinations thereof said control valve to maintain a minimum pressure in said chamber of said hydraulic cylinder to thereby control movement of said cushion platform when said upper press assembly applies a force thereto;

wherein said controller is operative to control said control valve to vary a value of said minimum pressure during a working stroke of said press machine;

wherein said controller includes control values that are used to control said control valve;

determining a thickness of said first part upon detection of contact of said upper press assembly with said first part and calculating whether said thickness is within a thickness tolerance of a preset thickness value;

causing said controller to cause increased pressure to be applied by said least one hydraulic cylinder supporting at least a portion of said cushion platform when said determined thickness is not within said thickness tolerance;

causing said controller to create a pulsating frequency force and a variable force to be applied to the blank during the pressing of the blank;

forming a first part using said press under a first preset force profile;

monitoring conditions of said press during said forming of said first part, said monitored conditions including at least one of a position of said upper press assembly, or a position, pressure, or velocity of said cushion platform;

comparing said monitored conditions of said upper press assembly with at least one of said monitored conditions of position or pressure of said cushion platform;

analyzing said monitored conditions or said compared monitored conditions to detect a defect in said first part selected from the group consisting of wrinkling of the formed first part and tearing of the first part;

altering at least one parameter of said first preset force profile when a defect in said first part is detected to form a second force profile, said first force profile modified in a manner to reduce recurrence of a defect in a second part; and forming said second part using said press under said second force profile.

15. The method of claim 14, wherein said method further comprises monitoring conditions of said press during said forming of said second part, said monitored conditions including at least one of a position of said upper press assembly, or a position or a pressure of said cushion platform, analyzing said monitored conditions to detect a defect in said second part; and, altering at least one parameter of said second force profile when a defect in said second part is detected to form a third force profile, said second force profile modified in a manner to reduce recurrence of said detected defect in a another part.

16. The method of claim 14, wherein said analyzing said monitored conditions includes I) comparing position data of said upper press assembly to position data of said cushion platform during pressing of said first part to determine if the thickness of said first part has increased during the pressing of said first part to detect formation of a wrinkle in said first part, and II) monitoring pressure data to said cushion platform during the pressing of said first part to detect a fluxuation in said pressure data to determine if a tear was formed in said first part.

17. The method of claim 14, wherein said analyzing said monitored conditions includes detecting a pressure relief spike corresponding to a tear in said part.

18. The method of claim 14, wherein said analyzing said monitored conditions includes detecting a velocity change in said cushion platform indicative of a tear in said part.

19. The method of claim 14, wherein said controller controls said control valve to cause a plurality of pressure pulses of hydraulic fluid to said at least one hydraulic cylinder, said controller including I) pulse frequency values to cause a certain a pulse width frequency of said plurality of pulses of hydraulic fluid to said at least one hydraulic cylinder, II) pulse amplitude values to cause a certain pulse amplitude of said plurality of pulses of hydraulic fluid to said at least one hydraulic cylinder, and combinations thereof.

20. A method of controlling a press cushion device of a press, wherein said method comprises:

providing a die press device for a press machine comprising:

an upper press assembly, said upper press assembly including a press slide and an upper die connected to said press slide;

a cushion platform, said cushion platform including a transfer plate, a bolster positioned at least partially above an upper surface of said transfer plate, a lower die positioned on an upper surface of said bolster, a plurality of transfer pins positioned between a top surface of said lower die and a bottom surface of a binder;

a hydraulic cylinder supporting at least a portion of said cushion platform, said cushion platform configured to move in response to a force applied thereto by said upper press assembly;

a control valve configured to permit flow, restrict flow, or combinations thereof of hydraulic fluid from a chamber of said at least one hydraulic cylinder; and;

a controller, said controller communicating with a) an upper press position indicator that indicates a position of one or more components of said upper press assembly, b) a cushion platform position indicator that indicates a position of one or more components of said cushion platform, and combinations thereof; said controller configured to selectively open, close, or combinations thereof said control valve to maintain a minimum pressure in said chamber of said hydraulic cylinder to thereby control movement of said cushion platform when said upper press assembly applies a force thereto;

wherein said controller is operative to control said control valve to vary a value of said minimum pressure during a working stroke of said press machine;

wherein said controller includes first and second control values that are used to control said control valve based on position information received from said upper press position indicator and said cushion platform position indicator, said first set of control values used to control said control valve at a first position when first position information is received from said controller, said second set of control values used to control said control valve at a second position when second position information is received by said controller, said controller controls said control valve to cause a plurality of pressure pulses of hydraulic fluid to said at least one hydraulic cylinder, said controller including I) pulse frequency values to cause a certain a pulse width frequency of said plurality of pulses of hydraulic fluid to said at least one hydraulic cylinder, II) pulse amplitude values to cause a certain pulse amplitude of said plurality of pulses of hydraulic fluid to said at least one hydraulic cylinder, and combinations thereof;

determining a thickness of said first part upon detection of contact of said upper press assembly with said first part and calculating whether said thickness is within a thickness tolerance of a preset thickness value;

providing said controller information from said upper press position indicator and said cushion platform position indicator upon detection of contact of said upper press assembly with said first part;

causing said controller to cause increased pressure to be applied by said at least one hydraulic cylinder supporting at least a portion of said cushion platform when said determined thickness is not within said thickness tolerance;

causing said controller to create a pulsating frequency force and a variable force to be applied to the blank during the pressing of the blank;

forming a first part using said press under a first force profile;

monitoring conditions of said press during said forming of said first part, said monitored conditions including at least one of a position of said upper press assembly, or a position, pressure, or velocity of said cushion platform;

comparing said monitored conditions of said upper press assembly with at least one of said monitored conditions of A) position of said cushion platform, B) pressure of said cushion platform, C) position of said upper press assembly, and any combination of A), B) and C);

analyzing said monitored conditions to detect a defect in said first part, said analyzing said monitored conditions includes i) comparing position data of said upper press assembly to position data of said cushion platform to detect formation of a wrinkle in said part, ii) detecting a pressure relief spike corresponding to a tear in said part, iii) detecting a velocity change in said cushion platform indicative of a tear in said part, and any combination of i), ii) and iii);

altering at least one parameter of said first force profile when a defect in said part is detected to form a second force profile, said first force profile modified in a manner to reduce recurrence of said detected defect; and forming a second part using said press under said second force profile.

* * * * *